US011117185B2

(12) United States Patent
Yabuguchi et al.

(10) Patent No.: US 11,117,185 B2
(45) Date of Patent: Sep. 14, 2021

(54) FASTENING TOOL

(71) Applicant: MAKITA CORPORATION, Anjo (JP)

(72) Inventors: Michisada Yabuguchi, Anjo (JP); Yuki Kawai, Anjo (JP); Hiroki Ikuta, Anjo (JP)

(73) Assignee: MAKITA CORPORATION, Anjo (JP)

( * ) Notice: Subject to any disclaimer, the term of this patent is extended or adjusted under 35 U.S.C. 154(b) by 55 days.

(21) Appl. No.: 16/624,161

(22) PCT Filed: Jun. 8, 2018

(86) PCT No.: PCT/JP2018/022118
§ 371 (c)(1),
(2) Date: Dec. 18, 2019

(87) PCT Pub. No.: WO2018/235640
PCT Pub. Date: Dec. 27, 2018

(65) Prior Publication Data

US 2020/0139424 A1 May 7, 2020

(30) Foreign Application Priority Data

Jun. 19, 2017 (JP) ..... JP2017-119966

(51) Int. Cl.
*B21J 15/26* (2006.01)
*B21J 15/10* (2006.01)
(Continued)

(52) U.S. Cl.
CPC ..... *B21J 15/26* (2013.01); *B21J 15/105* (2013.01); *B21J 15/28* (2013.01); *B21J 15/32* (2013.01); *B21J 15/36* (2013.01)

(58) Field of Classification Search
CPC . B21J 15/26; B21J 15/105; B21J 15/28; B21J 15/32; B21J 15/36; B21J 15/285; B21J 15/043
See application file for complete search history.

(56) References Cited

U.S. PATENT DOCUMENTS 5,473,805 A 12/1995 Wille
5,802,691 A 9/1998 Zoltaszek
(Continued)

FOREIGN PATENT DOCUMENTS

AU 2379099 A 11/1999
CA 2 282 100 A1 3/2001
(Continued)

OTHER PUBLICATIONS

Jan. 29, 2021 Extended Search Report issued in European Patent Application No. 18820637.9.
(Continued)

*Primary Examiner* — Ryan J. Walters
(74) *Attorney, Agent, or Firm* — Oliff PLC

(57) ABSTRACT

A fastening tool includes a housing, a fastener-abutment part, a pin-gripping part held within the fastener-abutment part to be movable in a front-rear direction relative to the fastener-abutment part, a detection-target part provided to move together with the pin-gripping part, a detection device configured to detect the detection-target part, a motor, and a driving mechanism configured to move the pin-gripping part rearward from an initial position relative to the fastener-abutment part. The driving mechanism is further configured to move the pin-gripping part forward relative to the fastener-abutment part so as to return the pin-gripping part to the initial position based on a detection result of the detection device. The fastening tool is configured such that a first moving distance is adjustable, the first moving distance being a distance by which the pin-gripping part is moved from a detection position to the initial position.

18 Claims, 11 Drawing Sheets

(51) Int. Cl.

| | |
|---|---|
| ***B21J 15/28*** | (2006.01) |
| ***B21J 15/32*** | (2006.01) |
| ***B21J 15/36*** | (2006.01) |

(56) References Cited

U.S. PATENT DOCUMENTS

| | | | | |
|---|---|---|---|---|
| 6,110,068 | A | 8/2000 | Kraska | |
| 6,145,360 | A * | 11/2000 | Honsel | B21J 15/26 72/19.8 |
| 2004/0063362 | A1 * | 4/2004 | Weeks | B21J 15/285 439/894 |
| 2010/0139067 | A1 | 6/2010 | Chen | |
| 2010/0275424 | A1 | 11/2010 | Masugata | |
| 2011/0108600 | A1 | 5/2011 | Pedicini et al. | |
| 2011/0239449 | A1 | 10/2011 | Masugata | |
| 2015/0033525 | A1 | 2/2015 | Sugata et al. | |
| 2015/0314762 | A1 | 11/2015 | Lee | |
| 2019/0283111 | A1 * | 9/2019 | Kawai | B21J 15/105 |
| 2020/0130047 | A1 * | 4/2020 | Yabunaka | B21J 15/326 |

FOREIGN PATENT DOCUMENTS

| | | | |
|---|---|---|---|
| CN | 101877515 | A | 11/2010 |
| CN | 102233402 | A | 11/2011 |
| CN | 204565044 | U | 8/2015 |
| CN | 105109471 | A | 12/2015 |
| CN | 205798316 | U | 12/2016 |
| DE | 10 2013 221792 | A1 | 5/2015 |
| EP | 0 527 414 | A1 | 2/1993 |
| EP | 0 953 390 | A2 | 11/1999 |
| JP | S63-228308 | A | 9/1988 |
| JP | 2011-218381 | A | 11/2011 |
| JP | 2013-173148 | A | 9/2013 |
| WO | 2011/018283 | A1 | 2/2011 |

OTHER PUBLICATIONS

Sep. 2, 2020 Office Action issued in Chinese Patent Application No. 201880040398.8.

* cited by examiner

FASTENING TOOL

TECHNICAL FIELD

The present invention relates to a fastening tool which is configured to fasten a workpiece via a fastener which has a pin and a cylindrical part through which the pin is inserted, and break the pin, thus completing a fastening operation.

BACKGROUND ART

Well known are a fastener (also referred to as a rivet or blind rivet) having a rod-like pin and a cylindrical part (also referred to as a rivet body or sleeve) which are formed integrally with each other with the pin being inserted through the cylindrical part, and a fastening tool for fastening a workpiece via such a fastener. In a fastening process using such a fastener, typically, the fastener is inserted through a mounting hole from one side of the workpiece, and the pin is pulled in an axial direction from the same side by the fastening tool. As a result, one end portion of the cylindrical part of the fastener deforms and thereby the workpiece is firmly clamped between the one end portion of the cylindrical part and a flange formed on the other end of the cylindrical part. Then the pin is broken at a small-diameter part for breakage, and the fastening operation is completed.

For example, Japanese laid-open patent publication No. 2013-173148 discloses a fastening tool having a jaw configured to grip the pin. The jaw has two halves configured to move toward and away from each other by moving in a front-rear direction and is mounted inside of a jaw case. When a feed-screw mechanism pulls the jaw and the jaw case rearward relative to a cover part, the halves move toward each other to grip the pin and pull the pin rearward to break it.

SUMMARY OF THE INVENTION

Problems to be Solved by the Invention

In the above-described fastening tool, the jaw and the jaw case are returned to an initial position on a front end portion side of the cover part after completion of the fastening operation. In the fastening tool having such a structure, for example, when a nozzle, the jaw or the jaw case is worn, the arrangement relation of the halves of the jaw (specifically, the inner diameter of the jaw) in the initial position may not be properly maintained, so that the jaw may no longer be able to properly grip the pin. In this case, it may be necessary to take countermeasures such as providing a spacer to fill a gap created due to wear.

Accordingly, considering such circumstances, it is an object of the present invention to provide a technique which may enable a pin-gripping part to properly grip a pin in an initial position in a fastening tool.

Means for Solving the Problem

According to one aspect of the invention, a fastening tool is provided which is configured to fasten a workpiece via a fastener. The fastener includes a pin and a cylindrical part through which the pin is inserted. The fastening tool includes a housing, a fastener-abutment part, a pin-gripping part, a detection-target part, a detection device, a motor and a driving mechanism.

The housing extends in a front-rear direction of the fastening tool along a specified driving axis. The fastener-abutment part has a cylindrical shape. The fastener-abutment part is held by a front end portion of the housing so as to be capable of abutting on the cylindrical part of the fastener. The pin-gripping part has a plurality of gripping claws which are configured to grip a portion of the pin of the fastener. Further, the pin-gripping part is coaxially held within the fastener-abutment part. The pin-gripping part is movable in the front-rear direction along the driving axis relative to the fastener-abutment part. Moreover, the pin-gripping part is configured such that its gripping force of gripping the pin is changed by movement of the plurality of gripping claws in a radial direction relative to the driving axis along with movement of the pin-gripping part in the front-rear direction relative to the fastener-abutment part.

The detection-target part is provided to move together with the pin-gripping part in the front-rear direction. The detection device is configured to detect the detection-target part when the pin-gripping part is placed in a specified detection position in the front-rear direction.

The driving mechanism is configured to be driven by power of the motor. The driving mechanism is configured to move the pin-gripping part rearward from an initial position along the driving axis relative to the fastener-abutment part so as to pull the pin gripped by the plurality of gripping claws and deform the cylindrical part abutting on the fastener-abutment part, thereby fastening the workpiece via the fastener and breaking the pin at a small-diameter part for breakage. Further, the driving mechanism is configured to move the pin-gripping part forward, after the breakage, along the driving axis relative to the fastener-abutment part so as to return the pin-gripping part to the initial position based on a detection result of the detection device. Further, the fastening tool is configured such that a first moving distance, which is a distance by which the pin-gripping part is moved from the detection position to the initial position, is adjustable.

The fastening tool of the present aspect is capable of adjusting the distance (the first moving distance) by which the pin-gripping part is moved from the detection position to the initial position. In a case where the first moving distance is adjusted, the initial position of the pin-gripping part in the front-rear direction can be changed. The pin-gripping part is configured such that its gripping force of gripping the pin is changed by movement of the gripping claws in the radial direction relative to the driving axis along with movement of the pin-gripping part in the front-rear direction relative to the fastener-abutment part. With such a structure, in a case where the initial position is changed in the front-rear direction, the gripping force of the gripping claws in the initial position may also be changed. Therefore, for example, in a case where the fastener-abutment part or the pin-gripping part is worn, by adjusting the first moving distance to be longer or shorter, the gripping force of the gripping claws in the initial position can be properly adjusted. Thus, the need for countermeasures using an additional member such as a spacer can be eliminated.

Examples of the fastener which can be used for the fastening tool of the present aspect may typically include a fastener which is referred to as a rivet or blind rivet. In a rivet or blind rivet, the pin and the cylindrical part (also referred to as a rivet body or sleeve) are integrally formed with each other. In such a fastener, typically, a flange is integrally formed on one end of the cylindrical part. Further, a shaft part of the pin extends through the cylindrical part. Further, the shaft part of the pin protrudes long from one end of the cylindrical part on which the flange is formed and a head protrudes adjacent to the other end of the cylindrical part. When the workpiece is fastened with such a fastener, the workpiece is clamped between one end portion (flange) of the cylindrical part and the other end portion of the cylindrical part which is deformed to be enlarged in diameter by the pin being pulled in an axial direction.

The housing may also be referred to as a tool body. The housing may be formed by connecting a plurality of parts including a part for housing a motor and a part for housing the driving mechanism. Further, the housing may have a one-layer structure or a two-layer structure.

The motor may be a direct current (DC) motor or an alternate current (AC) motor. The presence or absence of a brush is not particularly limited. However, a brushless DC motor may be preferably adopted since it is compact and has high output.

The structure of the fastener-abutment part is not particularly limited, but any known structure may be adopted. The fastener-abutment part may be held by the housing by being connected to the housing directly or via a different member. Further, the fastener-abutment part may be configured to be detachable from the housing. The structure of the pin-gripping part is not particularly limited, but any known structure may be adopted. Typically, the pin-gripping part may mainly include a jaw having a plurality of gripping claws and a holding part (also referred to as a jaw case) for the jaw. Further, the pin-gripping part may be configured to be detachable from the housing.

The detection-target part may preferably be provided on the pin-gripping part or on a member which is directly or indirectly connected to the pin-gripping part and moves together with the pin-gripping part. Further, the detection-target part may be a portion of the pin-gripping part or a portion of a member which moves together with the pin-gripping part. For example, when the driving mechanism is formed by a feed-screw mechanism or ball-screw mechanism which includes a rotary member and a movable member, the detection-target part may be provided on one of the rotary member and the movable member which is connected to the pin-gripping part and linearly moves in the front-rear direction.

The detection device may be capable of detecting the detection-target part when the pin-gripping part is placed in a specified detection position, and any known detection system may be adopted for the detection. For example, both a detection system of a non-contact type (such as a magnetic field detection system and an optical detection system) and a detection system of a contact type may be adopted.

As the driving mechanism, for example, a feed-screw mechanism or a ball-screw mechanism may be suitably adopted. Both the feed-screw mechanism and the ball-screw mechanism are capable of converting rotation into linear motion. In the feed-screw mechanism, a female thread part formed in an inner peripheral surface of a cylindrical rotary member and a male thread part formed in an outer peripheral surface of a movable member inserted through the rotary member are engaged (threadedly engaged) directly with each other. On the other hand, in the ball-screw mechanism, a spiral track is defined between the inner peripheral surface of the cylindrical rotary member and the outer peripheral surface of the movable member inserted through the rotary member. The rotary member and the movable member are engaged with each other via a number of balls which are rollably disposed within the spiral track. Typically, the rotary member may be held by the housing via a bearing, and the movable member may be directly or indirectly connected to the pin-gripping part. However, it may be configured such that the movable member is rotatably supported by the housing, while the rotary member is directly or indirectly connected to the pin-gripping part. Alternatively, for example, a rack and pinion mechanism may be adopted.

The driving mechanism may stop the pin-gripping part in the initial position based on a detection result obtained from the detection device each time the pin-gripping part is placed in the detection position, or may perform an operation of stopping the pin-gripping part in the initial position a plurality of times based on a detection result obtained when the pin-gripping part is placed in the detection position at a particular time. In other words, the detection and the stop may be performed in one-to-one relation in one cycle of the fastening process, or a result of detection performed once may be utilized to stop the pin-gripping part in the fastening process performed a plurality of times. It is noted that one cycle of the fastening process may refer to a process from when the driving mechanism moves the pin-gripping part rearward from the initial position until returning the pin-gripping part to the initial position.

In the fastening tool, a method of adjusting the distance (first moving distance) by which the pin-gripping part is moved from the detection position to the initial position is not particularly limited. For example, the first moving distance may be adjusted by mechanically adjusting the arrangement relation of the driving mechanism or other internal mechanisms. Such adjustment may be performed, for example, at the time of factory shipment of the fastening tool and in repair and maintenance after sale. Further, the fastening tool may be configured to adjust the first moving distance according to externally inputted information. It is noted that the "distance (first moving distance) by which the pin-gripping part is moved from the detection position to the initial position" can be rephrased as a distance by which the pin-gripping part (the detection-target part) is moved from a point of detection of the detection-target part by the detection device to a point of stop of the pin-gripping part. The first moving distance can be adjusted, for example, through an elapsed time from detection of the detection-target part to braking of the pin-gripping part, the number of driving pulses to be supplied to the motor after detection of the detection-target part, or an angle by which the motor is to be rotated after detection of the detection-target part.

According to one aspect of the present invention, the fastening tool may include an adjusting device configured to adjust the first moving distance. A method by which the adjusting device adjusts the first moving distance is not particularly limited. For example, the adjusting device may be configured to adjust the first moving distance according to information inputted via an operation part which can be externally operated by a user. Alternatively, for example, the adjusting device may automatically adjust the first moving distance in the next movement based on an actual distance by which the pin-gripping part was relatively moved in the past. According to the present aspect, since the adjusting device adjusts the first moving distance, the trouble of a fine mechanical adjustment work can be saved.

According to one aspect of the present invention, the fastening tool may further include a braking device configured to brake the pin-gripping part when the pin-gripping part is moved from the detection position by a second moving distance. Further, the adjusting device may be configured to adjust the first moving distance by adjusting the second moving distance. The distance (first moving distance) by which the pin-gripping part is moved from the detection position to the initial position may be the sum of a distance (second moving distance) by which the pin-gripping part is moved until start of braking of the braking device after detection of the detection device and a distance by which the pin-gripping part is moved until being actually stopped after start of braking. Therefore, the adjusting device can adjust the first moving distance by adjusting the second moving distance. It is noted that the manner of "braking the pin-gripping part" used herein may refer to both a manner of decelerating the pin-gripping part and a manner of stopping the pin-gripping part. The pin-gripping part may be braked by various methods, including stopping driving of the motor, applying torque to the motor in an opposite direction for a certain period of time, and interrupting power transmission in a power transmission path from the motor to the driving mechanism.

According to one aspect of the present invention, the detection position may be set on a way of the pin-gripping part to be moved forward to the initial position by the driving mechanism. Further, the braking device may be configured to, each time when the pin-gripping part is placed in the detection position and the detection-target part is detected by the detection device, brake the pin-gripping part when the pin-gripping part is moved by the second moving distance from the detection position of the detection. According to the present aspect, detection and braking can be performed in one-to-one relation each time the pin-gripping part is moved forward to the initial position, so that braking of the pin-gripping part and thus stop of the pin-gripping part in the initial position can be more accurately performed.

According to one aspect of the present invention, the adjusting device may be configured to adjust the second moving distance based on a past actual moving distance of the pin-gripping part after braked by the braking device.

According to one aspect of the present invention, the adjusting device may be configured to adjust the first moving distance according to information inputted via an operation part which is configured to be externally operable by a user. According to the present aspect, by operating the operation part, a user can appropriately correct actual displacement of the initial position of the pin-gripping part, which may be caused, for example, due to wear. It is noted that the operation part may be provided in the fastening tool, or the operation part may be configured as an external device configured to communicate with the fastening tool by wire or radio.

According to one aspect of the present invention, the fastening tool may further include a control device configured to control operation of the driving mechanism by controlling driving of the motor. The control device may be configured to stop the pin-gripping part in the initial position by braking the motor based on the detection result.

According to one aspect of the present invention, the adjusting device may be configured to adjust the first moving distance by adjusting a braking-standby time. The braking-standby time may be a time from when the detection-target part is detected by the detection device until the control device brakes the motor.

According to one aspect of the present invention, the fastening tool may further include a control device configured to control driving of the motor. The control device may be configured to control rotation speed of the motor when the driving mechanism moves the pin-gripping part forward along the driving axis relative to the fastener-abutment part. According to the present aspect, the control device can optimize time required for returning the pin-gripping part to the initial position and thus time required for one cycle of the fastening operation by controlling the rotation speed of the motor when returning the pin-gripping part to the initial position after completion of the fastening operation of the fastener.

According to one aspect of the present invention, the control device may be configured to perform constant-rotation-speed control of the motor when the driving mechanism moves the pin-gripping part forward along the driving axis relative to the fastener-abutment part. According to the present aspect, operation of the motor can be stabilized and the pin-gripping part can be more accurately stopped in the initial position. It is noted that the "constant-rotation-speed control" as used herein may refer to controlling the motor to be driven at a rotation speed within a specified range (in other words, to be driven with fluctuations in the rotation speed being suppressed to a specified threshold or smaller). It is noted that the constant-rotation-speed control may be performed, based on a constant rotation speed over the whole of the period for which the driving mechanism moves the pin-gripping part forward along the driving axis relative to the fastener-abutment part, or based on different rotation speeds for each of plural periods.

According to one aspect of the present invention, the control device may be configured to perform constant-rotation-speed control of the motor during at least for a specified period of time until the pin-gripping part reaches the detection position when the driving mechanism moves the pin-gripping part forward along the driving axis relative to the fastener-abutment part.

According to one aspect of the present invention, the detection-target part may include a magnet, and the detection device may include a Hall sensor. According to the present aspect, a simple structure can be provided using the Hall sensor and the magnet to detect the pin-gripping part placed in the detection position.

MODES FOR CARRYING OUT THE INVENTION

An embodiment of the present invention is now described with reference to the drawings. In the following embodiment, as an example, a fastening tool 1 is described which is capable of fastening a workpiece by using a fastener.

Figure 1:
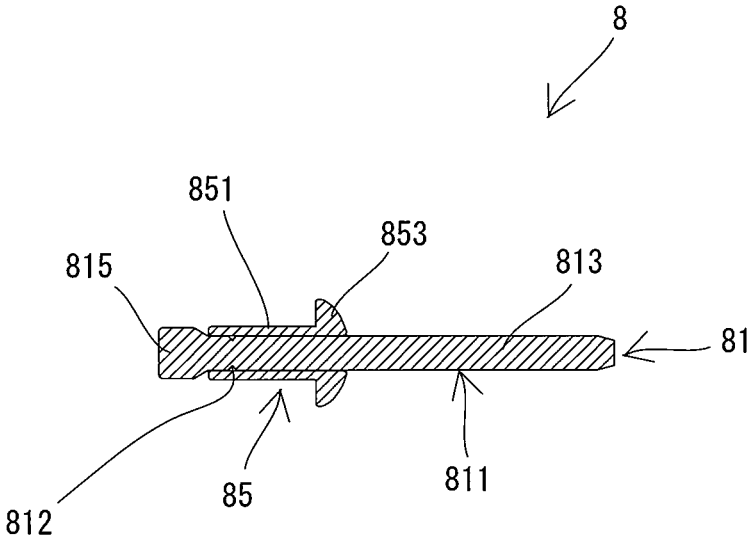
FIG. 1 illustrates a fastener (blind rivet).

First, a fastener 8 is described as an example of a fastener which can be used in the fastening tool 1, with reference to FIG. 1. The fastener 8 is a known fastener of a type which may be referred to as a blind rivet or rivet. The fastener 8 includes a pin 81 and a body 85 which are integrally formed with each other.

The body 85 is a cylindrical member which includes a cylindrical sleeve 851 and a flange 853 protruding radially outward from one end of the sleeve 851. The pin 81 is a rod-like member extending through the body 85 and protruding from both ends of the body 85. The pin 81 includes a shaft part 811 and a head 815 formed on one end portion of the shaft part 811. The head 815 has a larger diameter than the inner diameter of the sleeve 851 and is arranged to protrude from the other end of the sleeve 851 on the side opposite to the flange 853. The shaft part 811 extends through the body 85 and protrudes in an axial direction from the end of the body 85 on the side of the flange 853. A portion of the shaft part 811 which is disposed within the sleeve 851 has a small-diameter part 812 for breakage. The small-diameter part 812 has a less strength than other portions of the shaft part 811. The small-diameter part 812 is configured to be first broken when the pin 81 is pulled in the axial direction. A portion of the shaft part 811 on the side opposite to the head 815 across the small-diameter part 812 is referred to as a pintail 813. The pintail 813 is a portion to be separated from the pin 81 (the fastener 8) when the shaft part 811 is broken.

In the fastening tool 1, blind-rivet type fasteners other than the fastener 8 shown as an example in FIG. 1 can also be used which are different, for example, in the axial lengths or diameters of the pin 81 and the body 85, or the position of the small-diameter part 812.

The fastening tool 1 is now described. First, the general structure of the fastening tool 1 is described with reference to FIG. 2.

Figure 2:
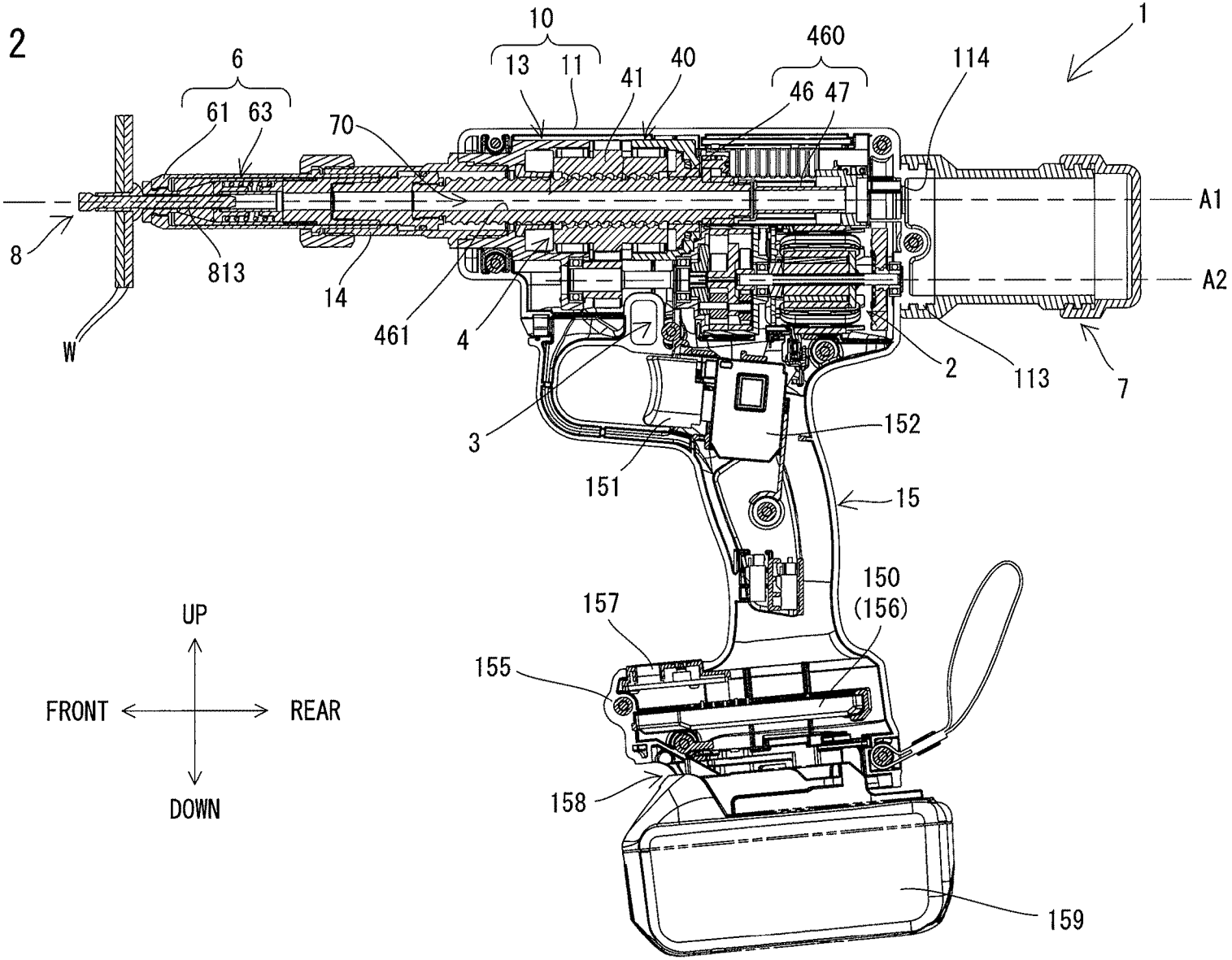
FIG. 2 is a longitudinal sectional view showing a fastening tool when a screw shaft is located in an initial position.

As shown in FIG. 2, an outer shell of the fastening tool 1 is mainly formed by an outer housing 11, a handle 15 and a nose part 6 which is held via a nose-holding member 14.

In the present embodiment, the outer housing 11 has a generally rectangular box-like shape and extends along a specified driving axis A1. The nose part 6 is held by one end portion of the outer housing 11 in a longitudinal direction via the nose-holding member 14, so as to extend along the driving axis A1. A collection container 7 is removably mounted to the other end portion of the outer housing 11. The collection container 7 is configured to store the pintail 813 (see FIG. 1) separated in a fastening process. The handle 15 protrudes in a direction crossing (in the present embodiment, a direction generally orthogonal to) the driving axis A1 from a central portion of the outer housing 11 in the longitudinal direction.

In the following description, for convenience of explanation, as for the direction of the fastening tool 1, an extending direction of the driving axis A1 (also referred to as a longitudinal direction of the outer housing 11) is defined as a front-rear direction of the fastening tool 1. In the front-rear direction, the side on which the nose part 6 is disposed is defined as a front side and the side on which the collection container 7 is removably mounted is defined as a rear side. Further, a direction which is orthogonal to the driving axis A1 and which corresponds to the extending direction of the handle 15 is defined as an up-down direction. In the up-down direction, the side on which the outer housing 11 is disposed is defined as an upper side and a protruding end (free end) side of the handle 15 is defined as a lower side. A direction orthogonal to the front-rear direction and the up-down direction is defined as a left-right direction.

As shown in FIG. 2, the outer housing 11 mainly houses a motor 2, a driving mechanism 4 which is configured to be driven by power of the motor 2 and a transmitting mechanism 3 which is configured to transmit power of the motor 2 to the driving mechanism 4. In the present embodiment, a portion (specifically, a nut 41 of a ball-screw mechanism 40) of the driving mechanism 4 is housed in an inner housing 13. The inner housing 13 is fixedly held by the outer housing 11. From this point of view, the outer housing 11 and the inner housing 13 can be considered as one piece in the form of a housing 10.

The handle 15 is configured to be held by a user. A trigger 151 is provided in an upper end portion (a base end portion connected to the outer housing 11) of the handle 15. The trigger 151 is configured to be depressed (pulled) by a user. A battery-mounting part 158 is provided in a lower end portion of the handle 15. The battery-mounting part 158 is configured such that a battery 159 is removably mounted thereto. The battery 159 is a rechargeable power source for supplying electric power to each part of the fastening tool 1 and the motor 2. The structures of the battery-mounting part 158 and the battery 159 are well known and therefore not described here.

The fastening tool 1 of the present embodiment is configured to fasten a workpiece via the fastener 8. The fastener 8 (see FIG. 1) is gripped by a jaw assembly 63 to be described later, in a state in which a portion of the pintail 813 is inserted into a front end portion of the nose part 6 of the fastening tool 1 and the body 85 and the head 815 protrude from a front end of the nose part 6. Then, the sleeve 851 is inserted through mounting holes formed in workpieces W up to a position where the flange 853 abuts on one side of the workpieces W to be fastened. When the trigger 151 is depressed, the driving mechanism 4 is driven via the motor 2. As a result, the pintail 813 gripped by the jaw assembly 63 is strongly pulled, and thus an end portion of the sleeve 851 on the head 815 side is enlarged in diameter and the workpieces W are clamped between this end portion and the flange 853. Further, the shaft part 811 is broken at the small-diameter part 812 and the pintail 813 is separated therefrom. Thereafter, the fastening process is completed when the jaw assembly 63 is returned forward by the driving mechanism 4.

As described above, in the present embodiment, the fastening tool 1 is configured to perform a fastening process for fastening a workpiece with the fastener 8, in one cycle of operations in which the driving mechanism 4 moves the jaw assembly 63 from a forward initial position to a rearward stop position and then returns the jaw assembly 63 to the initial position.

The physical structure of the fastening tool 1 is now described in detail.

Figure 3:
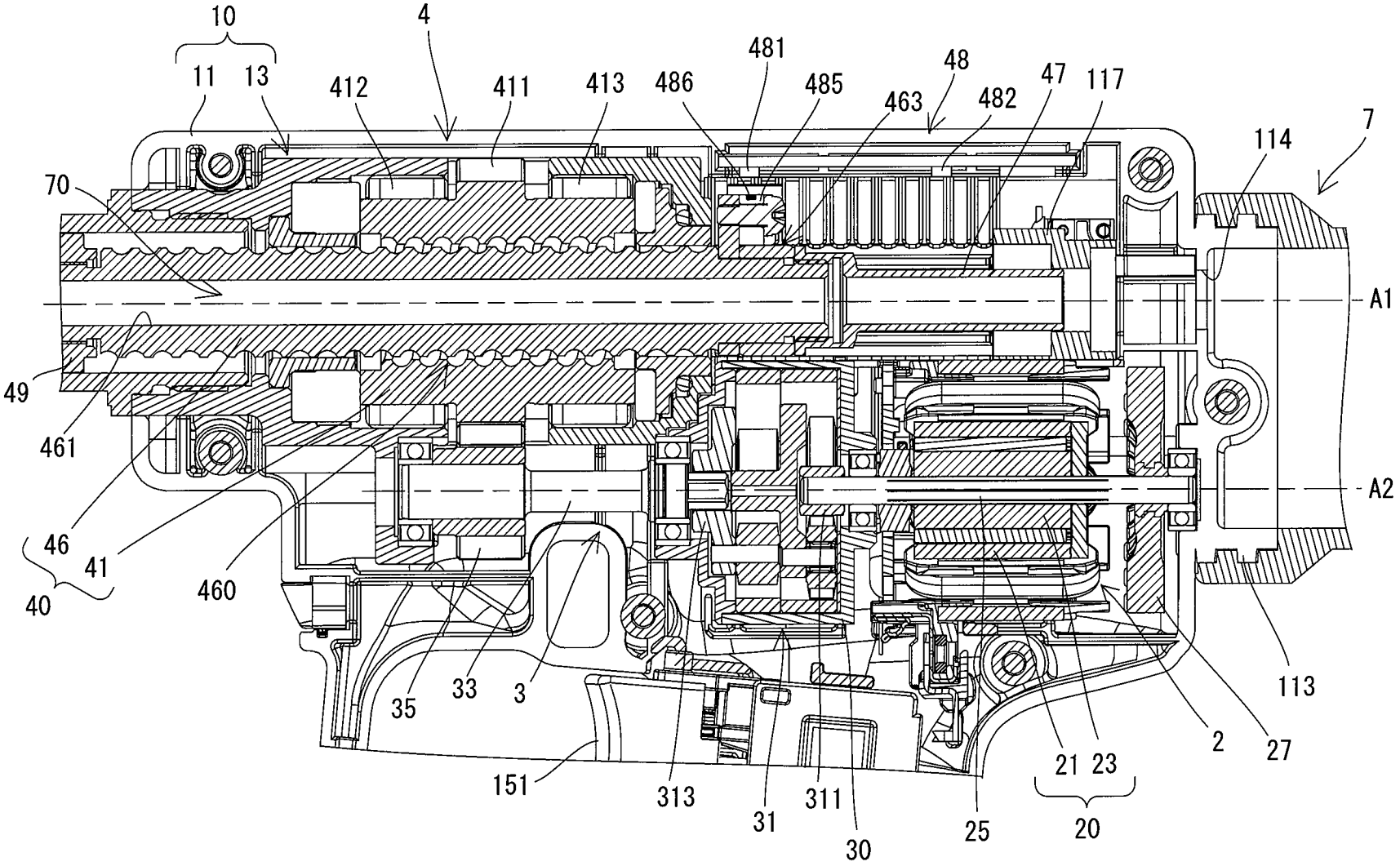
FIG. 3 is a partial, enlarged view of FIG. 2.

First, the motor 2 is described. As shown in FIG. 3, the motor 2 is housed in a lower portion of a rear end portion of the outer housing 11. In the present embodiment, a compact and high-output brushless DC motor is employed as the motor 2. The motor 2 includes a motor body 20, which includes a stator 21 and a rotor 23, and a motor shaft 25, which extends from the rotor 23 and rotates together with the rotor 23. The motor 2 is arranged such that a rotation axis A2 of the motor shaft 25 extends in parallel to the driving axis A1 (that is, in the front-rear direction) below the driving axis A1. Further, in the present embodiment, the entirety of the motor 2 is disposed below the driving axis A1. A front end portion of the motor shaft 25 protrudes into a speed-reducer housing 30. A fan 27 for cooling the motor 2 is fixed to a rear end portion of the motor shaft 25.

Next, the transmitting mechanism 3 is described. As shown in FIG. 3, in the present embodiment, the transmitting mechanism 3 mainly includes a planetary-gear reducer 31, an intermediate shaft 33 and a nut-driving gear 35, which are now described in this order.

The planetary-gear reducer 31 is disposed on the downstream side of the motor 2 on a power transmission path from the motor 2 to the driving mechanism 4 (specifically, a ball-screw mechanism 40). The planetary-gear reducer 31 is configured to increase torque of the motor 2 and transmit it to the intermediate shaft 33. In the present embodiment, the planetary-gear reducer 31 mainly includes two sets of planetary-gear mechanisms and the speed-reducer housing 30 which houses the planetary-gear mechanisms. It is noted that the speed-reducer housing 30 is formed of plastic and fixedly held by the outer housing 11 in front of the motor 2. The structure of the planetary-gear mechanism itself is well known and therefore not described in further detail here. The motor shaft 25 is an input shaft for inputting rotating power into the planetary-gear reducer 31. A sun gear 311 of a first (upstream) planetary-gear mechanism of the planetary-gear reducer 31 is fixed to a front end portion (the portion which protrudes into the speed-reducer housing 30) of the motor shaft 25. A carrier 313 of a second (downstream) planetary-gear mechanism is a final output shaft of the planetary-gear reducer 31.

The intermediate shaft 33 is configured to rotate together with the carrier 313. Specifically, the intermediate shaft 33 is rotatably disposed coaxially with the motor shaft 25 and its rear end portion is connected to the carrier 313. The nut-driving gear 35 is fixed onto an outer periphery of a front end portion of the intermediate shaft 33. The nut-driving gear 35 is engaged with a driven gear 411 formed on an outer periphery of the nut 41, which will be described later, and transmits the rotating power of the intermediate shaft 33 to the nut 41. The nut-driving gear 35 and the driven gear 411 are configured as a speed-reducing-gear mechanism.

The driving mechanism 4 is now described.

As shown in FIG. 3, in the present embodiment, the driving mechanism 4 mainly includes the ball-screw mechanism 40 which is housed in an upper portion of the outer housing 11. The structures of the ball-screw mechanism 40 and its peripheries are now described.

Figure 4:
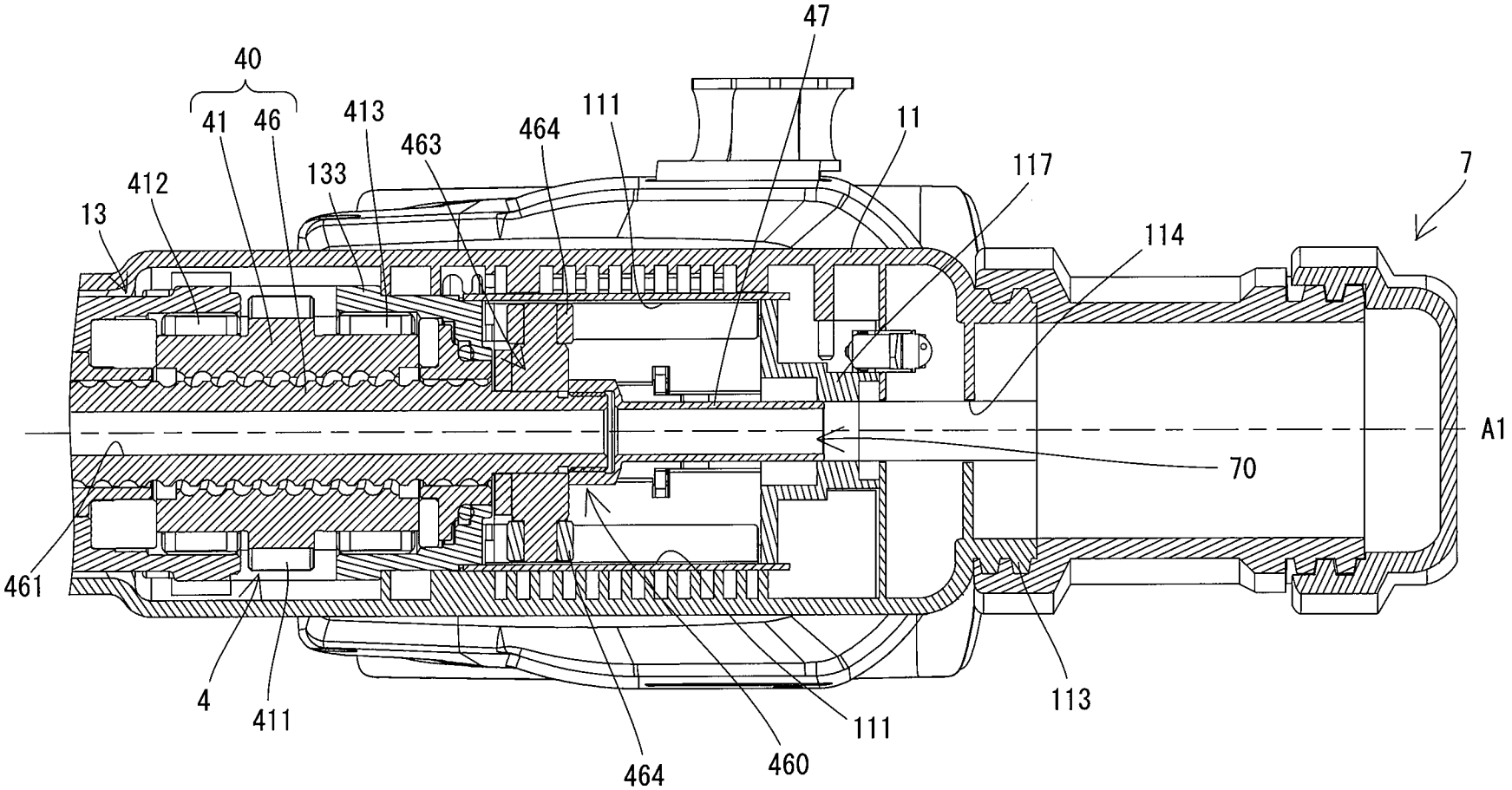
FIG. 4 is a cross-sectional view of a rear portion of the fastening tool.

As shown in FIGS. 3 and 4, the ball-screw mechanism 40 mainly includes the nut 41 and a screw shaft 46. In the present embodiment, the ball-screw mechanism 40 is configured to convert rotation of the nut 41 into linear motion of the screw shaft 46 and to linearly move the jaw assembly 63, which will be described later (see FIG. 5).

In the present embodiment, the nut 41 is supported by the inner housing 13 so as to be rotatable around the driving axis A1 while its movement in the front-rear direction is restricted. The nut 41 is cylindrically shaped and has the driven gear 411 integrally formed on its outer periphery. A pair of radial bearings 412, 413 are fitted onto the nut 41 on the front and rear sides of the driven gear 411. The nut 41 is supported via the radial bearings 412, 413 so as to be rotatable around the driving axis A1 relative to the inner housing 13. The driven gear 411 engages with the nut-driving gear 35. The driven gear 411 receives the rotating power of the motor 2 from the nut-driving gear 35, which causes the nut 41 to rotate around the driving axis A1.

The screw shaft 46 is engaged with the nut 41 so as to be movable in the front-rear direction along the driving axis A1 while its rotation around the driving axis A1 is restricted. Specifically, as shown in FIGS. 3 and 4, the screw shaft 46 is formed as an elongate member. The screw shaft 46 is inserted through the nut 41 and extends along the driving axis A1. A spiral track is defined by a spiral groove formed in an inner peripheral surface of the nut 41 and a spiral groove formed in an outer peripheral surface of the screw shaft 46. A number of balls (not shown) are rollably disposed within the spiral track. The screw shaft 46 is engaged with the nut 41 via these balls. Thus, the screw shaft 46 linearly moves along the driving axis A1 in the front-rear direction when the nut 41 is rotationally driven.

As shown in FIG. 4, a central portion of a roller-holding part 463 is fixed to a rear end portion of the screw shaft 46. The roller-holding part 463 has arms protruding orthogonally to the screw shaft 46 leftward and rightward from the central portion. Rollers 464 are rotatably held on right and left end portions of the arms, respectively. Roller guides 111 extending in the front-rear direction are fixed to right and left inner walls of the outer housing 11, respectively, corresponding to the pair of the right and left rollers 464. Although not shown in detail, each of the rollers 464 is restricted from moving upward and downward. Therefore, the roller 464 disposed within the roller guide 111 can roll along the roller guide 111 in the front-rear direction.

In the ball-screw mechanism 40 having the above-described structure, when the nut 41 is rotated around the driving axis A1, the screw shaft 46 engaged with the nut 41 via the balls linearly moves in the front-rear direction relative to the nut 41 and the housing 10. When the nut 41 is rotated, the screw shaft 46 may be subjected to torque around the driving axis A1. By abutment of the rollers 464 with the roller guides 111, however, rotation of the screw shaft 46 around the driving axis A1 due to such torque can be restricted.

The peripheral structure of the rear end portion of the screw shaft 46 and the internal structure of the rear end portion of the outer housing 11 in which the rear end portion of the screw shaft 46 is disposed are now described.

As shown in FIG. 3, a magnet-holding part 485 is fixed to the roller-holding part 463, which is fixed to the rear end portion of the screw shaft 46. The magnet-holding part 485 is disposed on an upper side of the screw shaft 46. A magnet 486 is mounted on an upper end of the magnet-holding part 485. The magnet 486 is fixed to be part of the screw shaft 46, so that the magnet 486 moves in the front-rear direction along with movement of the screw shaft 46 in the front-rear direction.

A position-detecting mechanism 48 is provided in the outer housing 11. In the present embodiment, the position-detecting mechanism 48 includes a first sensor 481 and a second sensor 482. The second sensor 482 is disposed rearward of the first sensor 481. Further, in the present embodiment, the first sensor 481 and the second sensor 482 are each configured as a Hall sensor having a Hall element. The first sensor 481 and the second sensor 482 are each electrically connected to a controller 156 (see FIG. 6) via wiring (not shown). The first sensor 481 and the second sensor 482 are configured to output respective specified detection signals to the controller 156 when the magnet 486 is located within their respective specified detection ranges. In the present embodiment, detection results by the first sensor 481 and the second sensor 482 are used to control driving of the motor 2 by the controller 156, which will be described in detail later.

As shown in FIGS. 3 and 4, an extension shaft 47 is coaxially connected and fixed to the rear end portion of the screw shaft 46 and integrated with the screw shaft 46. The screw shaft 46 and the extension shaft 47 which are integrated with each other are hereinafter also collectively referred to as a driving shaft 460. The driving shaft 460 has a through hole 461 extending therethrough along the driving axis A1. The diameter of the through hole 461 is set to be slightly larger than the largest possible diameter of a pintail of a fastener which can be used in the fastening tool 1.

An opening 114 is formed on the driving axis A1 in the rear end portion of the outer housing 11. The opening 114 allows communication between the inside and the outside of the outer housing 11. A cylindrical guide sleeve 117 is fixed in front of the opening 114. The guide sleeve 117 has an inner diameter which is substantially equal to the outer diameter of the extension shaft 47. A rear end of the extension shaft 47 (the driving shaft 460) is located within the guide sleeve 117 when the screw shaft 46 (the driving shaft 460) is placed in an initial position (the position shown in FIGS. 3 and 4). When the screw shaft 46 (the driving shaft 460) is moved rearward from the initial position along with rotation of the nut 41, the extension shaft 47 moves rearward while sliding within the guide sleeve 117.

As shown in FIGS. 3 and 4, a cylindrical container-connection part 113 is formed on the rear end portion of the outer housing 11. The container-connection part 113 protrudes rearward. The container-connection part 113 is configured such that the collection container 7 for the pintail 813 is removably attached thereto. The collection container 7 is formed as a cylindrical member with a lid. A user can attach the collection container 7 to the outer housing 11 via the container-connection part 113 such that the opening 114 communicates with the internal space of the collection container 7.

The structures of the nose part 6 and the nose-holding member 14 are now described.

First, the nose part 6 is described.

Figure 5:
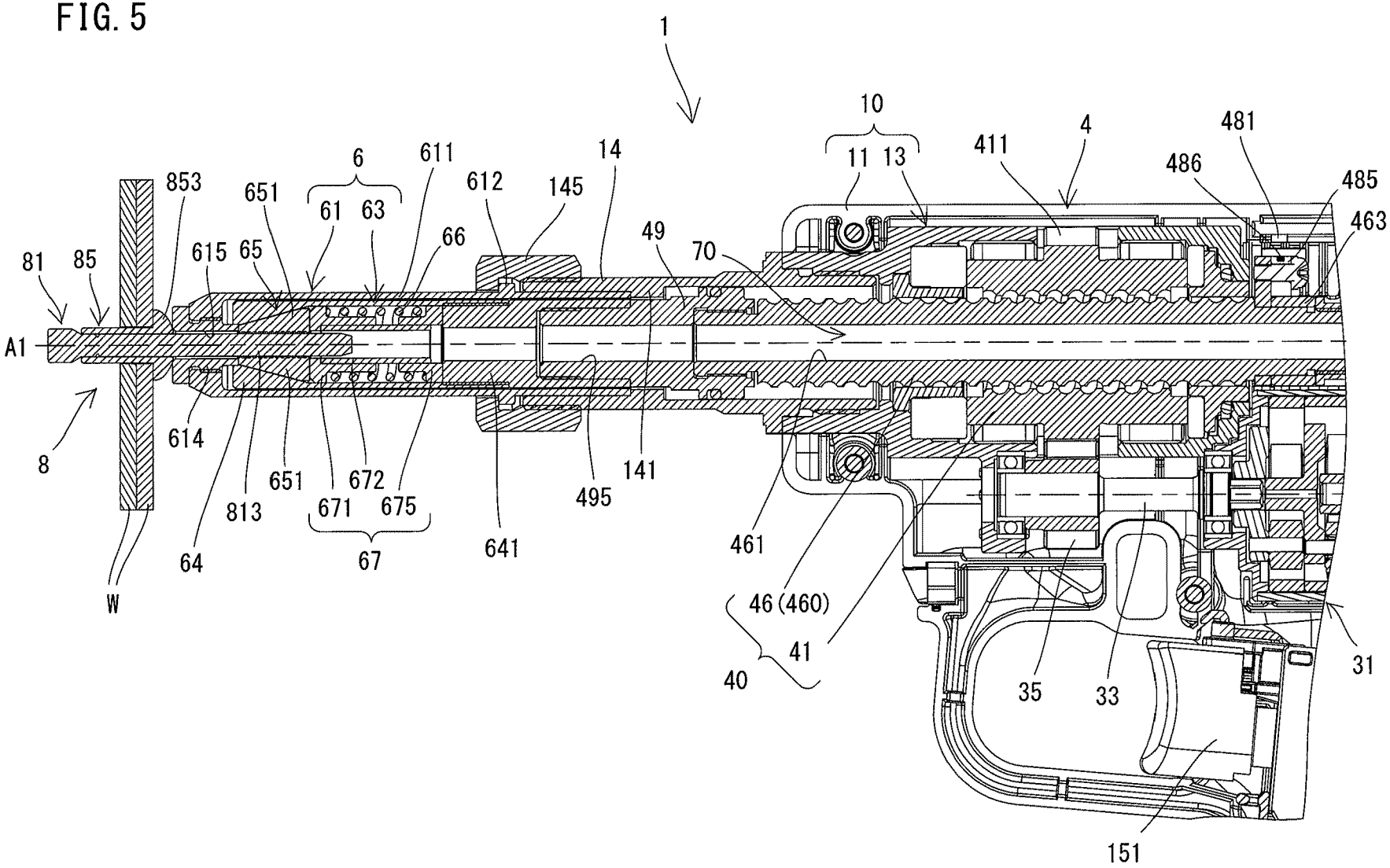
FIG. 5 is another partial, enlarged view of FIG. 2.

As shown in FIG. 5, the nose part 6 mainly includes a cylindrical anvil 61 and the jaw assembly 63 which is coaxially held within the anvil 61. The anvil 61 is configured to abut on the body 85 (the flange 853) of the fastener 8. The jaw assembly 63 is configured to grip the pin 81 (the pintail 813) of the fastener 8. The jaw assembly 63 is movable along the driving axis A1 relative to the anvil 61. In the present embodiment, the nose part 6 is configured to be removably attached to a front end portion of the housing 10 via the nose-holding member 14. In the following description, a direction of the nose part 6 is described on the basis of the state of the nose part 6 attached to the housing 10.

The anvil 61 is first described.

As shown in FIG. 5, in the present embodiment, the anvil 61 includes an elongate cylindrical sleeve 611 and a nose tip 614 fixed to a front end portion of the sleeve 611. The inner diameter of the sleeve 611 is set to be substantially equal to the outer diameter of a jaw case 64 of the jaw assembly 63, which will be described later. The sleeve 611 has locking ribs 612 formed at a region slightly toward a rear end from a central portion of an outer periphery of the sleeve 611. The locking ribs 612 protrude radially outward. The nose tip 614 is configured such that its front end portion can abut on the flange 853 of the fastener 8. Further, the nose tip 614 is disposed such that its rear end portion protrudes into the sleeve 611. The nose tip 614 has an insertion hole 615 through which the pintail 813 can be inserted.

The jaw assembly 63 is now described. As shown in FIG. 5, in the present embodiment, the jaw assembly 63 mainly includes the jaw case 64, a connecting member 641, a jaw 65 and a biasing spring 66, which are now described in this order.

The jaw case 64 is configured to be slidable within the sleeve 611 of the anvil 61 along the driving axis A1. Further, the jaw case 64 is cylindrically shaped to hold the jaw 65 inside. It is noted that the jaw case 64 has a substantially uniform inner diameter, except that only its front end portion is configured as a tapered part reducing in inner diameter toward the front. In other words, an inner peripheral surface of the front end portion of the jaw case 64 is configured as a conical tapered surface reducing in diameter toward its front end. Further, a front end portion of the cylindrical connecting member 641 is threadedly engaged with a rear end portion of the jaw case 64 and integrated with the jaw case 64. A rear end portion of the connecting member 641 is configured to be threadedly engaged with a front end portion of a connecting member 49, which will be described later.

The jaw 65 as a whole has a conical cylindrical shape, corresponding to the tapered surface of the jaw case 64. The jaw 65 is disposed coaxially with the jaw case 64 within a front end portion of the jaw case 64. The jaw 65 has a plurality of (for example, three) claws 651. The claws 651 are configured to grip a portion of the pintail 813 and arranged around the driving axis A1. An inner peripheral surface of the claw 651 has irregularities so as to improve ease of gripping the pintail 813.

The biasing spring 66 is disposed between the jaw 65 and the connecting member 641 in the front-rear direction. The jaw 65 is biased forward by a biasing force of the biasing spring 66 and its outer peripheral surface is held in abutment with the tapered surface of the jaw case 64. In the present embodiment, the biasing spring 66 is held by spring-holding members 67 disposed between the jaw 65 and the connecting member 641.

The spring-holding members 67 include a cylindrical first member 671 and a cylindrical second member 675. The first member 671 and the second member 675 are disposed to be slidable along the driving axis A1 within the jaw case 64. The first member 671 is disposed on the front side of the biasing spring 66 and abuts on the jaw 65, and the second member 675 is disposed on the rear side of the biasing spring 66 and abuts on the connecting member 641. The first member 671 and the second member 675 each have an outer diameter smaller than the inner diameter of the jaw case 64. Flanges are respectively provided on front end portion of the first member 671 and a rear end portion of the second member 675, and protrude radially outward. The outer diameters of the flanges are generally equal to the inner diameter of the jaw case 64 (except for the tapered part). The biasing spring 66 is mounted on the first member 671 and the second member 675 with its front and rear ends being in abutment with the flanges of the first member 671 and the second member 675, respectively. It is noted that a cylindrical sliding part 672 is fixed in the inside of the first member 671 and protrudes rearward. A rear end portion of the sliding part 672 is slidably inserted into the second member 675. The inner diameter of the sliding part 672 is substantially equal to the diameter of the through hole 461 of the screw shaft 46.

With the above-described structure, when the jaw case 64 moves in the direction of the driving axis A1 relative to the anvil 61, the arrangement relation between the jaw case 64 and the jaw 65 in the direction of the driving axis A1 is changed, due to the biasing force of the biasing spring 66. At this time, each of the claws 651 of the jaw 65 moves in both the direction of the driving axis A1 and a radial direction, while the tapered surface of an outer periphery of the claw 651 slides on the tapered surface of the jaw case 64, so that the adjacent claws 651 move toward or away from each other. As a result, the gripping force of the jaw 65 (the claws 651) gripping the pintail 813 is changed.

Specifically, when the screw shaft 46 is located in the initial position as shown in FIG. 5, the jaw 65 is held with the tapered surfaces of the outer peripheries of the claws 651 being in abutment with the tapered surface of the jaw case 64 and in abutment with a rear end of the above-described nose tip 614 protruding into the front end portion of the jaw case 64. It is noted that the initial position of the screw shaft 46 (the driving shaft 460) (the initial position of the jaw assembly 63) needs to be set to a position where the claws 651 of the jaw 65 can appropriately grip the pin 81. In the present embodiment, the initial position of the screw shaft 46 and the pin-gripping part 63 can be adjusted according to a value inputted via an operation part 157 by a user, which will be described in detail later.

When the jaw assembly 63 moves rearward along the driving axis A1 relative to the anvil 61, the jaw case 64 moves rearward relative to the jaw 65 biased forward by the biasing spring 66. The claws 651 move toward each other in the radial direction by interaction between the tapered surfaces of the claws 651 and the tapered surface of the jaw case 64. As a result, the gripping force of the jaw 65 (the claws 651) gripping the pintail 813 is increased so that the pintail 813 is firmly gripped. On the other hand, when the jaw assembly 63 is returned forward along the driving axis A1, the jaw 65 abuts on the rear end of the nose tip 614 and the jaw case 64 moves forward relative to the jaw 65. The claws 651 are thus allowed to move away from each other in the radial direction. As a result, the gripping force of the jaw 65 (the claws 651) gripping the pintail 813 is reduced so that the pintail 813 can be released from the jaw 65 by application of external force. The fastening process of the fastener 8 by the fastening tool 1 will be described later in detail.

The nose-holding member 14 is now described.

As shown in FIG. 5, the nose-holding member 14 is cylindrically formed. The nose-holding member 14 is fixed to a front end portion of the housing 10 and protrudes forward along the driving axis A1. More specifically, the nose-holding member 14 is threadedly engaged with a cylindrical front end portion of the inner housing 13 and thereby integrally connected to the housing 10. The inner diameter of a rear portion of the nose-holding member 14 is set to be larger than the outer diameter of the screw shaft 46. Further, the nose-holding member 14 has an annular locking part 141 protruding radially inward in its central portion in the front-rear direction. The inner diameter of the portion of the nose-holding member 14 which forms the locking part 141 is set to be substantially equal to the outer diameter of the jaw assembly 63. The inner diameter of a portion of the nose-holding member 14 which extends forward from the locking part 141 is set to be substantially equal to the outer diameter of the anvil 61.

The connecting member 49 is connected to a front end portion of the screw shaft 46. The connecting member 49 is a member for connecting the screw shaft 46 and the jaw assembly 63. The connecting member 49 is cylindrically formed and integrally connected to the screw shaft 46 with its rear end portion being threadedly engaged with the front end portion of the screw shaft 46. The connecting member 49 slides within the nose-holding member 14 along with movement of the screw shaft 46 in the front-rear direction. A front end portion of the connecting member 49 is threadedly engaged with a rear end portion of the jaw assembly 63 (specifically, the connecting member 641). Thus, the jaw assembly 63 is integrally connected to the screw shaft 46 via the connecting member 49. A through hole 495 extending through both of the connecting members 49, 641 along the driving axis A1 is defined by the connecting member 49 being connected to the connecting member 641. The diameter of the through hole 495 is generally equal to that of the through hole 461 of the screw shaft 46.

The nose part 6 is connected to the housing 10 as follows. After the jaw assembly 63 is connected to the connecting member 49 as described above, the rear end portion of the anvil 61 (specifically, the sleeve 611) is inserted into the nose-holding member 14. Further, a cylindrical fixing ring 145 is threadedly engaged with an outer periphery of the front end portion of the nose-holding member 14, so that the nose part 6 is connected to the housing 10 via the nose-holding member 14. The anvil 61 is positioned such that its rear end abuts on the locking part 141 of the nose-holding member 14 and the locking ribs 612 are disposed between a front end portion of the fixing ring 145 and a front end of the nose-holding member 14.

When the nose part 6 is connected to the housing 10 via the nose-holding member 14, as shown in FIG. 2, a passage 70 is defined which extends from a front end of the nose part 6 to the opening 114 of the outer housing 11 along the driving axis A1. More specifically, the passage 70 is formed by the insertion hole 615 of the nose tip 614, the inside of the jaw 65, the inside of the spring-holding members 67, the through hole 495 (see FIG. 5) of the connecting members 641, 49, the through hole 461 of the driving shaft 460 and the opening 114. The pintail 813 separated from the fastener 8 may be passed through the passage 70 and stored in the collection container 7.

The handle 15 is now described.

As shown in FIG. 2, the trigger 151 is provided on the front side of an upper end portion of the handle 15. A switch 152 is housed within the handle 15 behind the trigger 151. The switch 152 may be switched on and off according to depressing operation of the trigger 151.

A lower end portion of the handle 15 has a rectangular box-like shape and forms a controller housing part 155. A main board 150 is housed in the controller housing part 155. On the main board 150, the controller 156 for controlling operations of the fastening tool 1, a three-phase inverter 201 and a current-detecting amplifier 205 which are described below are mounted. In the present embodiment, a control circuit formed by a microcomputer including a CPU, a ROM, a RAM and a timer is adopted as the controller 156. Further, an operation part 157, through which various information can be inputted by a user's external operation, is provided on a top of the controller housing part 155. In the present embodiment, the operation part 157 has buttons for inputting information (specifically, a value for increasing/decreasing a set value of a moving distance D1 (braking-standby time) which will be described later) for adjusting the initial position of the screw shaft 46 and the jaw assembly 63.

The electric configuration of the fastening tool 1 is now described.

Figure 6:
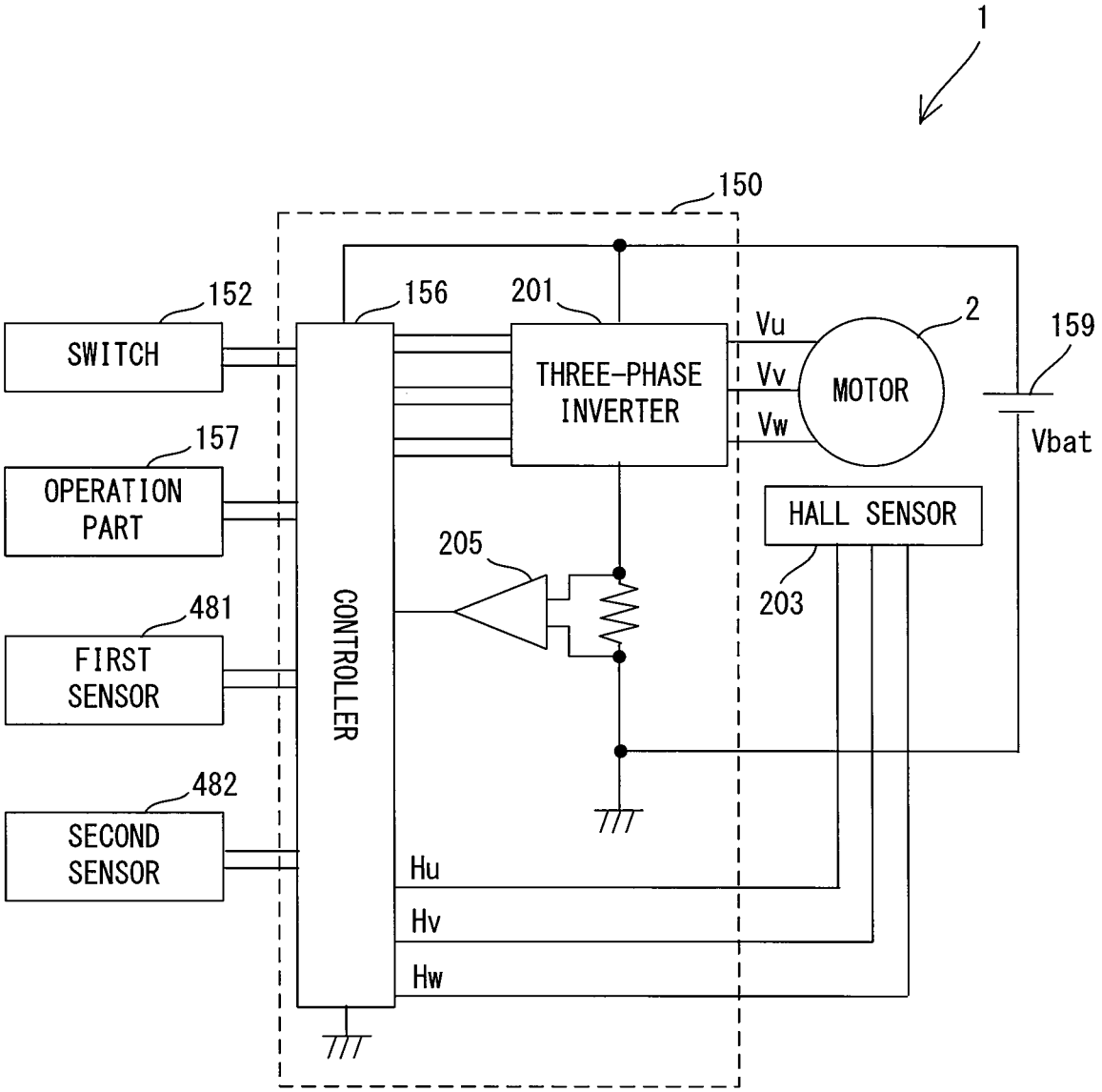
FIG. 6 is a block diagram showing an electric configuration of the fastening tool.

As shown in FIG. 6, the fastening tool 1 includes the controller 156, the three-phase inverter 201 and a Hall sensor 203. The three-phase inverter 201 has a three-phase bridge circuit using six semiconductor switching elements. The three-phase inverter 201 performs switching operation of each switching element of the three-phase bridge circuit according to a duty ratio indicated by a control signal from the controller 156 and thereby supplies a pulsed electric current (driving pulse) corresponding to the duty ratio to the motor 2. The Hall sensor 203 has three Hall elements which are disposed corresponding to three phases of the motor 2, respectively, and is configured to output a signal indicating the rotation angle of the rotor 22. The controller 156 controls the rotation speed of the motor 2 by controlling energization to the motor 2 via the three-phase inverter 201 based on a signal inputted from the Hall sensor 203. Further, the rotation speed of the motor 2 is controlled by PWM (pulse width modulation).

The current-detecting amplifier 205 is also electrically connected to the controller 156. The current-detecting amplifier 205 converts the driving current of the motor 2 into voltage by a shunt resistor and outputs a signal amplified by the amplifier to the controller 156.

Furthermore, the switch 152 of the trigger 151, the operation part 157, the first sensor 481 and the second sensor 482 are electrically connected to the controller 156. The controller 156 appropriately controls driving of the motor 2 (operation of the driving mechanism 4) based on signals outputted from the switch 152, the operation part 157, the first sensor 481 and the second sensor 482.

Figure 7:
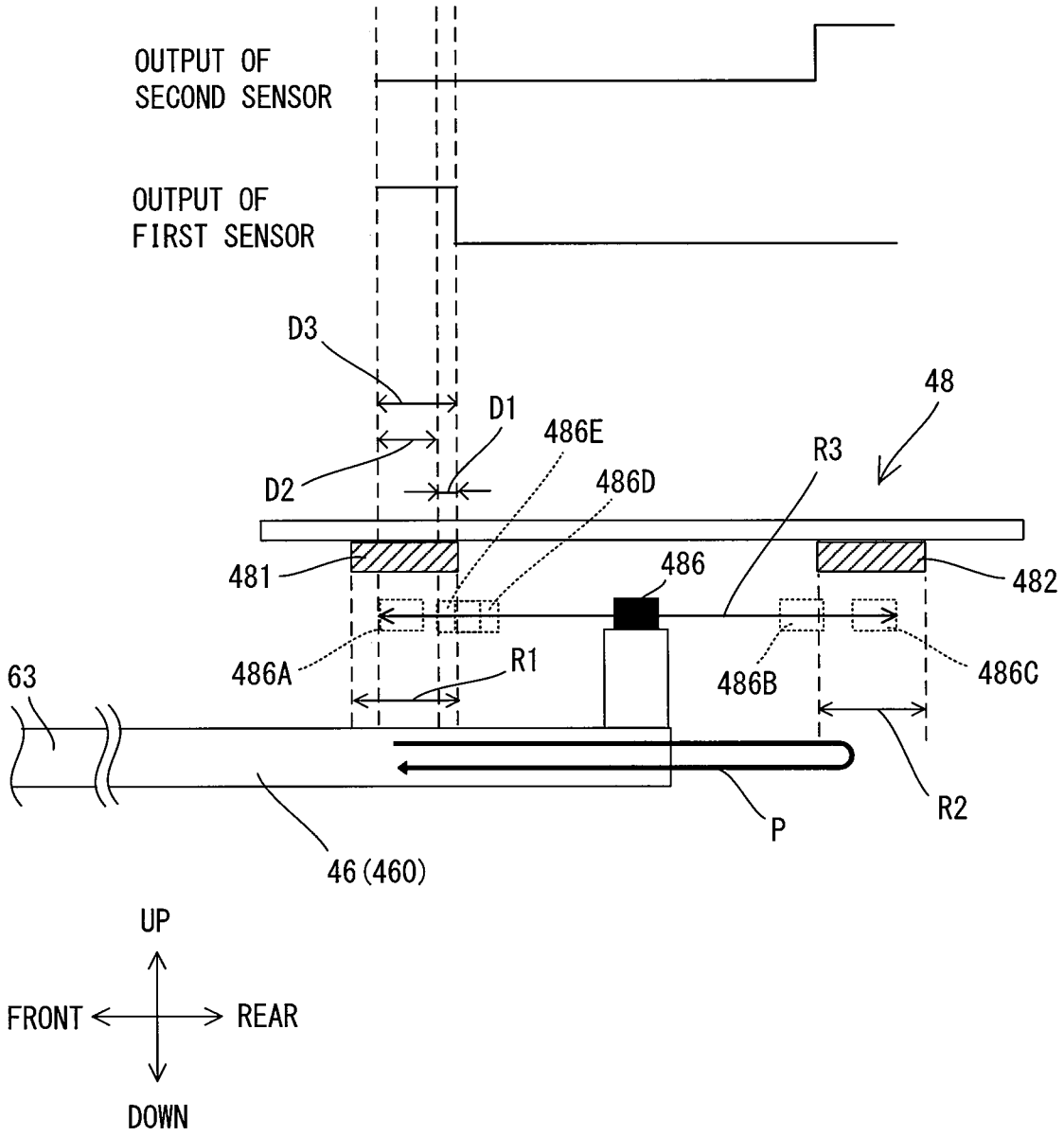
FIG. 7 is an explanatory drawing for illustrating the relationship between the positions of the screw shaft and a jaw assembly in a front-rear direction and first and second sensors.

In the present embodiment, as described above, in one cycle of the fastening process of the fastener 8, the screw shaft 46 is moved rearward from the initial position to the stop position and then returned forward from the stop position to the initial position. Although the details about the processing will be described later, the screw shaft 46 is moved through drive control of the motor 2 by the controller 156 based on detection results of the first sensor 481 and the second sensor 482. Now, the relationship between the position of the screw shaft 46 in the front-rear direction and the first and second sensors 481 and 482 in the present embodiment is described with reference to FIG. 7. As described above, the magnet 486 is integrally provided on the screw shaft 46, so that the positions of the screw shaft 46 and the jaw assembly 63 correspond to the position of the magnet 486. In FIG. 7, a moving range of the magnet 486 is shown by an arrow R3, and a direction of movement of the magnet 486 in one cycle of the fastening process is shown by an arrow P.

As shown in FIG. 7, when the screw shaft 46 is placed in the initial position, the magnet 486 is located substantially in the center (a position shown by 486A) of a detection range R1 of the first sensor 481. At this time, the first sensor 481 detects the magnet 486 and outputs a detection signal to the controller 156. When the screw shaft 46 is moved rearward and the magnet 486 gets out of the detection range R1, the output of a detection signal from the first sensor 481 is turned off. When the screw shaft 46 is further moved rearward and the magnet 486 reaches a position shown by 486B and enters a detection range R2 of the second sensor 482, the second sensor 482 starts outputting a detection signal. The position of the screw shaft 46 where the magnet 486 is detected by the second sensor 482 in the process of rearward movement of the screw shaft 46 is hereinafter referred to as a rear detection position.

When the screw shaft 46 is placed in the rear detection position, the motor 2 is braked. As a result, the screw shaft 46 moves rearward until the motor 2 stops completely and stops in the stop position. When the screw shaft 46 is placed in the stop position, the magnet 486 is located substantially in the center of the detection range R2 (a position shown by 486C). At this time, the second sensor 482 outputs a detection signal.

When the screw shaft 46 is moved forward from the stop position and the magnet 486 gets out of the detection range R2, the output of a detection signal from the second sensor 482 is turned off. When the screw shaft 46 is further moved forward and the magnet 486 reaches a position shown by 486D and enters the detection range R1, the first sensor 481 starts outputting a detection signal. The position of the screw shaft 46 where the magnet 486 is detected by the first sensor 481 in the process of forward movement of the screw shaft 46 is hereinafter referred to as a front detection position. When the screw shaft 46 moves forward from the front detection position by the preset moving distance D1 and the magnet 486 reaches a position shown by 486E, the motor 2 is braked and thus the screw shaft 46 is also braked. The position of the screw shaft 46 at this time is referred to as a braking-start position. After the motor 2 is braked, the screw shaft 46 continues to move forward until the motor 2 stops completely, and then stops in the initial position.

As described above, in the present embodiment, in the process of being returned to the initial position, the screw shaft 46 is braked via the motor 2 when moved to the braking-start position which is located forward of the front detection position by the moving distance D1. The screw shaft 46 is moved forward from the braking-start position by a moving distance D2 while being decelerated, and stops in the initial position. A moving distance D3 of the screw shaft 46 from the front detection position to the initial position is the sum of the moving distance D1 and the moving distance D2. Therefore, the moving distance D3 also increases or decreases corresponding to increase or decrease of the moving distance D1.

The relationship between the position of the screw shaft 46 in the front-rear direction and the first and second sensors 481 and 482 has been described so far, but the same is true of the relationship between the position of the jaw assembly 63 in the front-rear direction which corresponds to the position of the screw shaft 46 in the front-rear direction, and the first and second sensors 481 and 482, since the jaw assembly 63 moves together with the screw shaft 46 in the front-rear direction as described above. In the following description, for simplification of explanation, the position of the screw shaft 46 is used for explanation, but the term "position of the screw shaft 46" can be replaced with the "position of the jaw assembly 63".

As described above, in the present embodiment, the initial position of the screw shaft 46 (the driving shaft 460) (or the initial position of the jaw assembly 63) needs to be set to a position where the claws 651 of the jaw 65 can properly grip the pin 81. Specifically, the initial position is preferably set to a position where the pintail 813 can be inserted into the jaw 65 and where the claws 651 can loosely grip the pintail 813 inserted into the jaw 65 with a gripping force which is strong enough to prevent the fastener 8 from slipping out of the nose part 6 by its own weight. At the time of factory shipment, the initial position is set to an appropriate position. However, wear or displacement of the anvil 61 and the jaw assembly 63 (the jaw case 64 or the jaw 65) may occur afterwards. In such a case, the gripping force of the jaw 65 in the initial position set at the time of factory shipment may be changed with time, so that the jaw 65 may become incapable of properly gripping the pin 81. Further, the gripping force a user feels proper may be slightly different from user to user.

Therefore, the fastening tool 1 of the present embodiment is configured such that the initial position of the screw shaft 46 can be adjusted. More specifically, a user can input a value for changing the set moving distance D1 by operating the operation part 157. In the present embodiment, a time (hereinafter referred to as a braking-standby time) from when the magnet 486 is detected in the position shown by 486D in FIG. 7 by the first sensor 481 until braking of the motor 2 is started is used as a parameter which corresponds to the moving distance D1. An initial value of the braking-standby time is preset according to the specifications and rotation speeds of the motor 2, and stored, for example, in the ROM of the controller 156. The higher the rotation speed of the motor 2, the longer it takes to brake, so that the braking-standby time is set shorter. The controller 156 adjusts the initial value of the braking-standby time, or a set value changed from the initial value, according to a value inputted via the operation part 157. In this manner, the moving distance D3 of the screw shaft 46 from the front detection position to the initial position, that is, the initial position of the screw shaft 46 can be adjusted.

Figure 8:
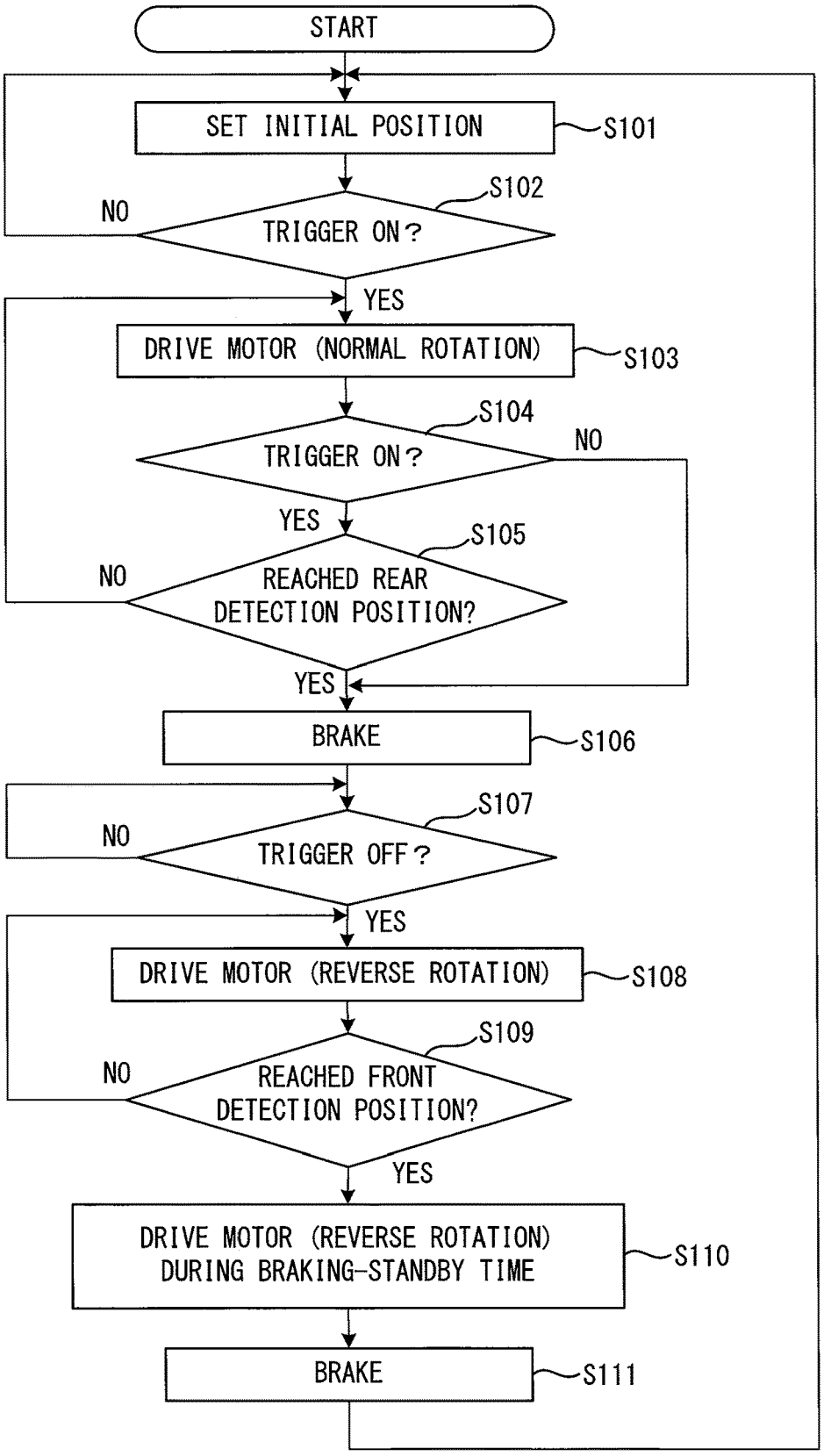
FIG. 8 is a flowchart showing drive control processing of a motor.
Figure 9:
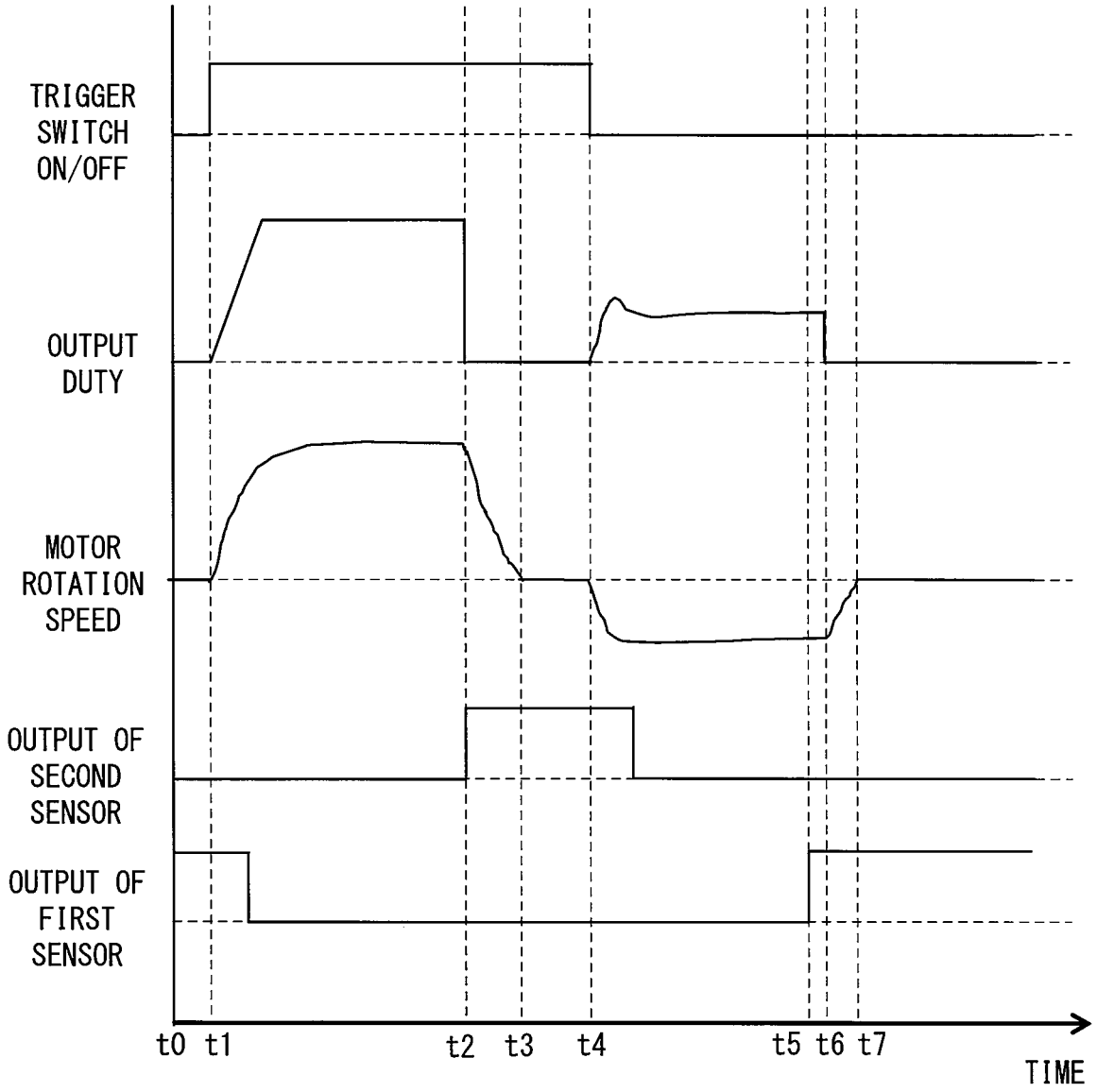
FIG. 9 is a time chart showing operations of a switch of a trigger, the motor, the first sensor and the second sensor.

Drive control processing of the motor 2 which is executed by the controller 156 (specifically, the CPU) in the fastening process of the fastener 8 is now described with reference to FIGS. 8 to 11. The drive control processing of the motor 2 which is shown in FIG. 8 is started when power supply to the fastening tool 1 is started by the battery 159 being mounted to the battery-mounting part 158, and is terminated when the power supply is stopped. In the following description, each "step" in the processing is simply expressed as "S".

The screw shaft 46 is placed in the initial position at the start of the drive control processing of the motor 2 (at the start of the fastening process). Therefore, as shown at time t0 in FIG. 9, the first sensor 481 outputs a detection signal, while the output of the second sensor 482 is off. Further, the switch 152 of the trigger 151 is off, and an output duty ratio and the rotation speed of the motor 2 are zero. As shown in FIG. 8, when the processing is started, the controller 156 sets the initial position (S101). Specifically, the controller 156 reads into the RAM the initial value of the braking-standby time which is stored in advance in the ROM. In a case where the controller 156 receives input from the operation part 157, the controller 156 changes the initial value according to the inputted value and stores it as a set value to be used in subsequent processing. Thus, in S101, the initial position preset at the time of factory shipment may be changed according to the inputted value.

In a case where the controller 156 has a nonvolatile memory, if the initial value of the braking-standby time is changed, the latest set value of the braking-standby time may be stored in the nonvolatile memory. In this case, when the drive control processing of the motor is started anew, the set value stored in the nonvolatile memory may be read out and used. In this case, a user can be saved the trouble of operating the operation part 157 to readjust the initial value each time the motor drive control processing is performed.

The controller 156 continues the processing for setting the initial position according to input from the operation part 157 while the switch 152 of the trigger 151 is off (S102: NO, S101). As described above, a user mounts the pin 81 to the front end of the nose part 6 such that the jaw 65 loosely grips the pin 81, and inserts the body 85 through mounting holes of the workpieces W (see FIG. 5). When the user depresses the trigger 151, the switch 152 is turned on (S102: YES). Accordingly, the controller 156 starts driving of the motor 2 (S103) (at time t1 in FIG. 9). More specifically, the controller 156 starts energization to the motor 2 via the three-phase inverter 201. The direction of rotation of the motor 2 (the rotor 23) at this time is set to a direction of normal rotation to move the screw shaft 46 rearward relative to the housing 10. Further, the duty ratio is set to 100%.

Figure 10:
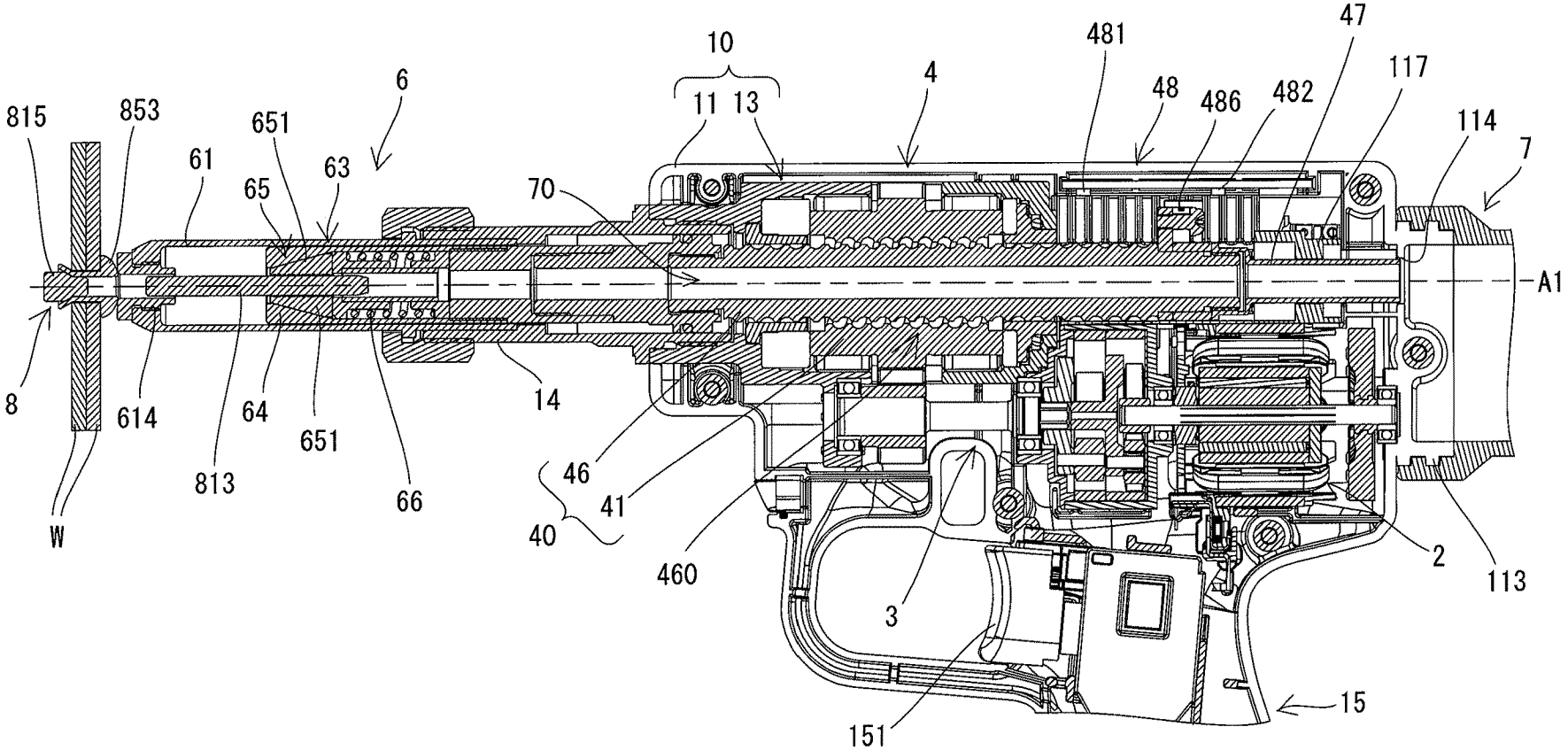
FIG. 10 is an explanatory drawing for illustrating a fastening process and a longitudinal sectional view showing the fastening tool when the screw shaft is located between the initial position and a stop position.

The controller 156 monitors a detection signal of the second sensor 482 while the switch 152 is on, and continues driving of the motor 2 when the screw shaft 46 does not yet reach the rear detection position (when the output of a detection signal of the second sensor 482 is off) (S104: YES, S105: NO, S103) (during a period of time between time t1 and time t2 in FIG. 9). During this period, the screw shaft 46 and the jaw assembly 63 are moved rearward, so that the pin 81 is firmly gripped by the jaw 65 and pulled rearward. Further, the magnet 486 gets out of the detection range R1 of the first sensor 481, so that the output of the detection signal from the first sensor 481 is turned off. As shown in FIG. 10, the fastening tool 1 fastens the workpieces W with the fastener 8 and breaks the pin 81 before the screw shaft 46 is moved to the rear detection position corresponding to the second sensor 482. The pintail 813 gripped by the jaw 65 is separated from the pin 81. Thereafter, the screw shaft 46 and the jaw assembly 63 are further moved rearward with the separated pintail 813 being gripped by the jaw 65.

Figure 11:
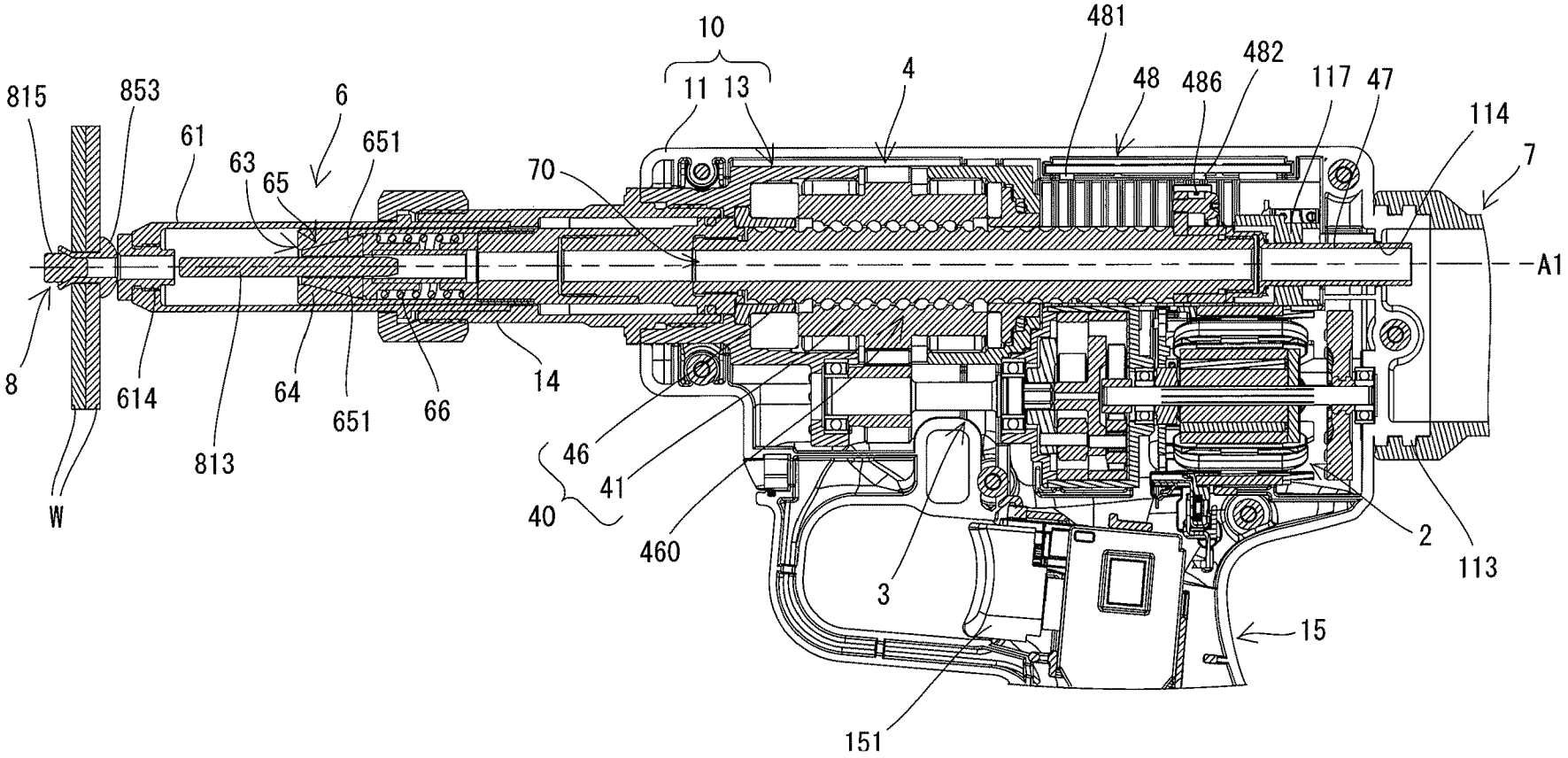
FIG. 11 is an explanatory drawing for illustrating the fastening process and a longitudinal sectional view showing the fastening tool when the screw shaft is located in the stop position.

When the screw shaft 46 reaches the rear detection position and the controller 156 recognizes a detection signal from the second sensor 482 (S105: YES), the controller 156 brakes (decelerates) the screw shaft 46 and the jaw assembly 63 by braking the motor 2 (S106) (at time t2 in FIG. 9). In a case where the operation of depressing the trigger 151 is released and the switch 152 is turned off (S104: NO), the controller 156 also brakes the motor 2 (S106). In the present embodiment, the controller 156 stops energization to the motor 2 (sets the duty ratio to zero) to brake the motor 2. When the rotation speed of the motor 2 is reduced to zero due to braking the motor 2, the screw shaft 46 stops in the stop position (at time t3 in FIG. 9). At this time, as shown in FIG. 11, the magnet 486 is located right below the second sensor 482.

The controller 156 monitors a signal from the switch 152 of the trigger 151 and stands by while the switch 152 is on (S107: NO, S107) (during a period of time between time t3 and time t4 in FIG. 9). During this period, the screw shaft 46 is stopped in the stop position and the magnet 486 is located within the detection range R2 of the second sensor 482, so that the second sensor 482 outputs a detection signal.

When a user releases the operation of depressing the trigger 151, the switch 152 is turned off (S107: YES). Accordingly, the controller 156 starts driving of the motor 2 (S108) (at time t4 in FIG. 9). More specifically, the controller 156 starts energization to the motor 2 via the three-phase inverter 201. The direction of rotation of the motor 2 at this time is set to a direction of reverse rotation to move the screw shaft 46 forward relative to the housing 10. In the present embodiment, when the screw shaft 46 moves forward, the controller 156 performs constant-rotation-speed control. The constant-rotation-speed control refers to controlling the motor 2 to be driven at a rotation speed within a specified range (in other words, to be driven with fluctuations in the rotation speed being suppressed to a specified threshold or smaller). The rotation speed at this time is set to a maximum speed to the extent that stable braking can be realized after the screw shaft 46 reaches the braking-start position, and the duty ratio is set below 100%.

The controller 156 monitors a detection signal of the first sensor 481, and continues driving of the motor 2 when the screw shaft 46 does not yet reach the front detection position (when the output of the detection signal of the first sensor 481 is off) (S109: NO, S108) (during a period of time between time t4 and time t5 in FIG. 9). During this period, the screw shaft 46 and the jaw assembly 63 are moved forward with the separated pintail 813 being gripped by the jaw 65. Further, the magnet 486 gets out of the detection range R2 of the second sensor 482, so that the output of the detection signal from the second sensor 482 is turned off.

When the screw shaft 46 reaches the front detection position and the controller 156 recognizes the detection signal from the first sensor 481 (S109: YES), the controller 156 starts timing with a timer and continues driving of the motor 2 until the braking-standby time stored in the RAM elapses (S110) (during a period of time between time t5 and time t6 in FIG. 9). Specifically, the screw shaft 46 is moved forward by the moving distance D1 corresponding to the braking-standby time. When the braking-standby time elapses, the controller 156 brakes (decelerates) the screw shaft 46 and the jaw assembly 63 by braking the motor 2 (S111) (at time t6 in FIG. 9). Further, in S111, like in S106, the controller 156 also stops energization to the motor 2 (sets the duty ratio to zero) to brake the motor 2. When the rotation speed of the motor 2 is reduced to zero due to braking of the motor 2, the screw shaft 46 stops in the initial position (at time t7 in FIG. 9), and one cycle of the fastening process is completed. Then the controller 156 returns to the processing in S101.

As described above, in the fastening tool 1 of the present embodiment, the jaw assembly 63 is moved rearward relative to the anvil 61 while the claws 651 of the jaw 65 grip the pin 81. The jaw assembly 63 is returned forward to the initial position after the workpieces W are fastened via the fastener 8 and the pin 81 is broken. The jaw assembly 63 is moved to the initial position based on the detection result of the magnet 486 which moves together with the jaw assembly 63 in the front-rear direction. The magnet 486 is detected by the first sensor 481 when the jaw assembly 63 is placed in the front detection position. In the present embodiment, a simple structure is provided, using the first sensor 481 configured as a Hall sensor having Hall elements and the magnet 486 mounted to the screw shaft 46, to detect the jaw assembly 63 placed in the detection position.

The jaw assembly 63 further moves from the front detection position by the moving distance D3 and stops in the initial position. In the present embodiment, the controller 156 is capable of adjusting the moving distance D3 of the jaw assembly 63 from the front detection position to the initial position. In a case where the moving distance D3 is adjusted, the initial position of the jaw assembly 63 is changed accordingly. The jaw assembly 63 is configured such that its gripping force of gripping the pin 81 is changed by movement of the claws 651 in the radial direction relative to the driving axis A1 along with movement of the jaw assembly 63 in the front-rear direction relative to the anvil 61. With such a structure, in a case where the initial position of the jaw assembly 63 is changed in the front-rear direction, the gripping force of the claws 651 in the initial position is also changed. Therefore, for example, in a case where the anvil 61 or the jaw assembly 63 is worn, the controller 156 can properly adjust the gripping force of the claws 651 in the initial position by adjusting the moving distance D3 to be longer or shorter. Thus, there is no need for countermeasures using an additional member such as a spacer.

Particularly, in the present embodiment, the controller 156 is configured to adjust the moving distance D3 according to a value which is inputted from the operation part 157 by user's external operation. Therefore, by operating the operation part 157, a user can appropriately correct displacement of the initial position of the jaw assembly 63 which may be caused, for example, due to wear. Further, by operating the operation part 157, a user can adjust the initial position of the jaw assembly 63 such that the claws 651 exert a desired gripping force.

Further, in the present embodiment, the controller 156 is configured to brake and stop the jaw assembly 63 via braking of the motor 2. Further, the controller 156 is configured to adjust the moving distance D3 of the jaw assembly 63 from the front detection position to the initial position by adjusting the moving distance D1 from the front detection position to the braking-start position (specifically, the braking-standby time corresponding to the moving distance D1). The moving distance D3 of the jaw assembly 63 from the front detection position to the initial position is the sum of the moving distance D1 and the moving distance D2 by which the jaw assembly 63 moves until actually stopping after start of braking of the jaw assembly 63 (the motor 2). Therefore, the initial position can be adjusted by adjusting the moving distance D1. Further, in the present embodiment, the controller 156 brakes the jaw assembly 63 in a simple way of stopping driving of the motor 2.

In the present embodiment, the front detection position is set on the way of the jaw assembly 63 to be moved forward to the initial position by the driving mechanism 4. Each time the jaw assembly 63 is placed in the front detection position and the magnet 486 is detected by the first sensor 481, the controller 156 brakes the motor 2 when the jaw assembly 63 moves forward by the moving distance D1 from the front detection position of the detection (when the braking-standby time elapses). In other words, each time the jaw assembly 63 is moved forward toward the initial position, detection and braking are performed in one-to-one relation. Therefore, braking of the jaw assembly 63 and thus stop of the jaw assembly 63 in the initial position can be more accurately performed.

In the present embodiment, the controller 156 which controls driving of the motor 2 is configured to control the rotation speed of the motor 2 when the driving mechanism 4 moves the jaw assembly 63 forward along the driving axis A1 relative to the anvil 61. By this control, time required for returning the jaw assembly 63 to the initial position and thus time required for one cycle of the fastening operation can be optimized. Particularly, in the present embodiment, by performing constant-rotation-speed control, operation of the motor 2 can be stabilized and the jaw assembly 63 can be more accurately stopped in the initial position.

The above-described embodiment is a mere example of the invention and a fastening tool according to the present invention is not limited to the structure of the fastening tool 1. For example, the following modifications may be made. Further, one or more of these modifications may be employed independently or in combination with the fastening tool 1 of the above-described embodiment or the claimed invention.

The structures of the motor 2, the transmitting mechanism 3 and the driving mechanism 4 may be appropriately changed. For example, the motor 2 may be a motor with a brush or may be an AC motor. The number of the planetary-gear mechanisms of the planetary-gear reducer 31 and arrangement of the intermediate shaft 33 may be changed. Further, as the driving mechanism 4, for example, a feed-screw mechanism may be employed, in place of the ball-screw mechanism 40 having the nut 41 and the screw shaft 46 engaged with the nut 41 via the balls. The feed-screw mechanism may include a nut having a female thread formed in its inner periphery, and a screw shaft having a male thread formed in its outer periphery and threadedly engaged directly with the nut. Further, the ball-screw mechanism 40 may be configured such that the screw shaft 46 is supported in a state in which its movement in the front-rear direction is restricted and its rotation is allowed, and the nut 41 moves in the front-rear direction along with the rotation of the screw shaft 46. In this case, the jaw assembly 63 may be directly or indirectly connected to the nut 41.

The structures of the anvil 61 and the jaw assembly 63 of the nose part 6 may be appropriately changed. For example, the shape of the anvil 61 and the manner of connecting the anvil 61 to the housing 10 may be changed. As long as the jaw assembly 63 is configured such that its gripping force of gripping the pin 81 is changed by movement of the jaw 65 (the claws 651) in the radial direction along with movement of the jaw assembly 63 in the front-rear direction relative to the anvil 61, the shapes of the jaw case 64 and the claws 651, the structure of the spring-holding members 67 and the manner of connecting the jaw assembly 63 to the screw shaft 46, for example, may be appropriately changed.

In the above-described embodiment, the controller 156 adjusts the moving distance D3 of the jaw assembly 63 from the front detection position to the initial position by changing the braking-standby time based on a value inputted from the operation part 157 according to user's external operation. The braking-standby time corresponds to the moving distance D1 from the front detection position to the braking-start position. The controller 156 may automatically adjust the moving distance D3 for the next movement of the jaw assembly 63 from the front detection position to the initial position, based on a past actual distance by which the jaw assembly 63 was moved from the front detection position to the initial position. For example, the controller 156 may adjust the moving distance D3 of the jaw assembly 63 from the front detection position to the initial position by changing the braking-standby time based on an actual angle by which the motor 2 was rotated (that is, an actual moving distance) after start of braking. The actual rotation angle of the motor 2 may be specified by outputs from the Hall sensor 203. Further, in a case where the actual moving distance differs from the set moving distance D3, the controller 156 may move the jaw assembly 63 to correct the position of the jaw assembly 63 by driving the motor 2 in the direction of normal rotation or the direction of reverse rotation.

A parameter other than the braking-standby time may be employed for adjusting the moving distance D3 (the moving distance D1). Examples may include the number of driving pulses to be supplied to the motor 2, or the angle (number of revolutions) by which the motor 2 is to be rotated, for a period of time from detection of the magnet 486 to start of braking of the motor 2.

In the above-described embodiment, the driving mechanism 4 stops the jaw assembly 63 in the stop position based on the detection result obtained from the first sensor 481 each time the jaw assembly 63 is placed in the front detection position. The driving mechanism 4 may, however, be configured to perform an operation of stopping the jaw assembly 63 in the initial position a plurality of times based on a detection result obtained when the jaw assembly 63 is placed in a particular detection position at a particular time. For example, upon power-up of the fastening tool 1, the jaw assembly 63 (the screw shaft 46) may be placed in an origin position by using a contact type or non-contact type origin sensor. The origin position may be, for example, a foremost or rearmost position within a movable range in the front-rear direction. In a subsequent fastening process, the driving mechanism 4 may just stop the jaw assembly 63 in the initial position based on the detection result of the origin sensor.

Specifically, the controller 156 may control the motor 2 based on the number of driving pluses supplied to the motor 2 to move the jaw assembly 63 from the origin position to the braking-start position via the initial position and the stop position and then brake the motor 2 in the braking-start position. Thereafter, the controller 156 may just repeat the cycle of moving the jaw assembly 63 from the initial position to the braking-start position via the stop position and braking the motor 2 in the braking-start position by controlling the motor 2 based on the number of driving pluses supplied to the motor 2. Thus, detection of the origin position by the origin sensor need not be performed in each fastening process, and the detection result of the origin sensor upon power up may be used in one or more subsequent fastening processes. In this case, the controller 156 can adjust the moving distance of the jaw assembly 63 from the origin position to the braking-start position by changing the number of driving pulses, automatically or according to input from the operation part 157.

In the above-described embodiment, a magnetic-field-detection type sensor is employed as the first sensor 481 and the second sensor 482, but a sensor of a different type (for example, an optical sensor such as a photo interrupter) or a mechanical switch may be employed. The same is true of the above-described origin sensor.

In the above-described embodiment, the motor is driven as it is while the jaw assembly 63 is moved from the front detection position to the braking-start position. When the jaw assembly 63 is moved to the braking-start position, driving of the motor 2 is stopped, so that the jaw assembly 63 is braked. Instead of this processing, the jaw assembly 63 may be braked, for example, by applying torque to the motor 2 in an opposite direction for a certain period of time. In this case, the motor 2 may be driven as it is, or driving of the motor may be stopped and the motor may be rotated by inertia, while the jaw assembly 63 is moved from the front detection position to the braking-start position. Further, the jaw assembly 63 may be braked by interruption of power transmission from the motor 2 to the nut 41.

In the above-described embodiment, the controller 156 performs the constant-rotation-speed control of the motor 2 over the whole of the period for which the jaw assembly 63 moves from the stop position to the front detection position. However, the constant-rotation-speed control need not be performed over the whole period. For example, in order to reduce the time required for one cycle of the fastening process, the controller 156 may rotationally drive the motor 2 at the maximum speed for a specified period of time from the stop position and thereafter perform constant-rotation-speed control at reduced rotation speed. In this case, the constant-rotation-speed control may be preferably performed at least in the braking-start position, or more preferably in the front detection position. Therefore, for example, the constant-rotation-speed control may be performed at high speed in the first half of the period in which the jaw assembly 63 is moved from the stop position to the front detection position, while being performed at low speed in the second half of the period. In other words, the constant-rotation-speed control may be performed over the whole period, during which the rotation speed is reduced stepwise.

In the above-described embodiment, the operation part 157 to which a value for changing the moving distance D3 (the moving distance D1) is inputted is provided in the fastening tool 1. However, in the case of the fastening tool 1 which is configured to communicate by wire or radio with an external device (for example, a mobile terminal) which can be externally operated by a user, the controller 156 may be configured to adjust the moving distance D3 (the moving distance D1) based on information inputted from the external device through the communication.

In the above-described embodiment and its modifications, the controller 156 is formed by a microcomputer including a CPU, a ROM and a RAM. However, a controller (control circuit) may be formed, for example, by a programmable logic device such as an ASIC (Application Specific Integrated Circuit) and an FPGA (Field Programmable Gate Array). Further, the drive control processing of the above-described embodiment and its modifications may be performed by the CPU executing a program stored in the ROM. In this case, the program may be stored in advance in the ROM of the controller 156, or in a nonvolatile memory if the controller 156 has it. Alternatively, the program may be stored in an external computer-readable storage medium (such as a USB memory). The drive control processing of the above-described embodiment and its modifications may be distributed to a plurality of control circuits.

Correspondences between the features of the above-described embodiment and its modifications and the features of the invention may be as follows. The fastener 8 is an example that corresponds to the "fastener" according to the present invention. The pin 81 and the body 85 are examples that correspond to the "pin" and the "cylindrical part", respectively, according to the present invention.

The fastening tool 1 is an example that corresponds to the "fastening tool" according to the present invention. The driving axis A1 is an example that corresponds to the "driving axis" according to the present invention. The housing 10 is an example that corresponds to the "housing" according to the present invention. The anvil 61 is an example that corresponds to the "fastener-abutment part" according to the present invention. The jaw assembly 63 is an example that corresponds to the "pin-gripping part" according to the present invention. The claws 651 of the jaw 65 are an example that corresponds to the "plurality of gripping claws" according to the present invention. The motor 2 is an example that corresponds to the "motor" according to the present invention. The driving mechanism 4 is an example that corresponds to the "driving mechanism" according to the present invention. The magnet 486 is an example that corresponds to the "detection-target part" and the "magnet" according to the present invention. The first sensor 481 is an example that corresponds to the "detection device" and the "Hall sensor" according to the present invention. The controller 156 (CPU) is an example that corresponds to the "adjusting device", the "braking device" and the "control device" according to the present invention. The initial position, the front detection position and the braking-start position are examples that correspond to the "initial position", the "detection position" and the "braking-start position", respectively, according to the present invention. The moving distance D3 is an example that corresponds to the "first moving distance" according to the present invention. The moving distance D1 is an example that corresponds to the "second moving distance" according to the present invention. The operation part 157 is an example that corresponds to the "operation part" according to the present invention.

Further, in view of the nature of the present invention, the above-described embodiment and its modifications, the following features are provided. The following features can be employed in combination with the fastening tool 1 of the embodiment, the above-described modifications or the claimed invention.

(Aspect 1)

The fastening tool may further comprise:

a control device that is configured to control operation of the driving mechanism by controlling driving of the motor, wherein:

the control device is configured to stop the pin-gripping part in the initial position by braking the motor based on the detection result.

(Aspect 2)

The control device may be configured to perform constant-rotation-speed control of the motor at least for a specified period of time until the pin-gripping part reaches the detection position when the driving mechanism moves the pin-gripping part forward along the driving axis relative to the fastener-abutment part.

(Aspect 3)

In aspect 1, the adjusting device may be configured to adjust the first moving distance by adjusting a braking-standby time which is a time from when the detection-target part is detected by the detection device until the control device brakes the motor.

(Aspect 4)

The adjusting device may be configured to adjust the second moving distance based on a past actual moving distance of the pin-gripping part after braked by the braking device.

DESCRIPTION OF THE NUMERALS

1: fastening tool, 10: housing, 11: outer housing, 111: roller guide, 113: container-connection part, 114: opening, 117: guide sleeve, 13: inner housing, 14: nose-holding member, 141: locking part, 145: fixing ring, 15: handle, 150: main board, 151: trigger, 152: switch, 155: controller housing part, 156: controller, 157: operation part, 158: battery-mounting part, 159: battery, 2: motor, 20: motor body, 21: stator, 22: rotor, 23: rotor, 25: motor shaft, 27: fan, 201: three-phase inverter, 203: Hall sensor, 205: current-detecting amplifier, 3: transmitting mechanism, 30: speed-reducer housing, 31: planetary-gear reducer, 311: sun gear, 313: carrier, 33: intermediate shaft, 35: nut-driving gear, 4: driving mechanism, 40: ball-screw mechanism, 41: nut, 411: driven gear, 412: radial bearing, 413: radial bearing, 46: screw shaft, 460: driving shaft, 461: through hole, 463: roller-holding part, 464: roller, 47: extension shaft, 48: position-detecting mechanism, 481: first sensor, 482: second sensor, 485: magnet-holding part, 486: magnet, 49: connecting member, 495: through hole, 6: nose part, 61: anvil, 611: sleeve, 612: locking rib, 614: nose tip, 615: insertion hole, 63: jaw assembly, 64: jaw case, 641: connecting member, 65: jaw, 651: claw, 66: biasing spring, 67: spring-holding member, 671: first member, 672: sliding part, 675: second member, 7: collection container, 70: passage, 8: fastener, 81: pin, 811: shaft part, 812: small-diameter part, 813: pintail, 815: head, 85: body, 851: sleeve, 853: flange, A1: driving axis, A2: rotation axis, W: workpiece

The invention claimed is:

1. A fastening tool configured to fasten a workpiece via a fastener, the fastener having a pin and a cylindrical part through which the pin is inserted, the fastening tool comprising:

a housing extending in a front-rear direction of the fastening tool along a driving axis;

a cylindrical fastener-abutment part held by a front end portion of the housing so as to be capable of abutting on the cylindrical part;

a pin-gripping part having a plurality of gripping claws configured to grip a portion of the pin, the pin-gripping part being coaxially held within the fastener-abutment part so as to be movable in the front-rear direction along the driving axis relative to the fastener-abutment part, the pin-gripping part being configured such that its gripping force of gripping the pin is changed by movement of the plurality of gripping claws in a radial direction relative to the driving axis along with movement of the pin-gripping part in the front-rear direction relative to the fastener-abutment part;

a detection-target part provided to move together with the pin-gripping part in the front-rear direction;

a detection device configured to detect the detection-target part when the pin-gripping part is placed in a detection position in the front-rear direction;

a motor; and a driving mechanism configured to be driven by power of the motor and to move the pin-gripping part rearward from an initial position along the driving axis relative to the fastener-abutment part so as to pull the pin gripped by the plurality of gripping claws and deform the cylindrical part abutting on the fastener-abutment part, thereby fastening the workpiece via the fastener and breaking the pin at a small-diameter part for breakage, driving mechanism being further configured to move the pin-gripping part forward, after the breakage, along the driving axis relative to the fastener-abutment part so as to return the pin-gripping part to the initial position based on a detection result of the detection device, wherein:

the fastening tool is configured such that a first moving distance is adjustable, the first moving distance being a distance by which the pin-gripping part is moved from the detection position to the initial position.

2. The fastening tool as defined in claim 1, further comprising an adjusting device configured to adjust the first moving distance.

3. The fastening tool as defined in claim 2, wherein the adjusting device is configured to adjust the first moving distance according to information inputted via an operation part, the operation part being configured to be externally operable by a user.

4. The fastening tool as defined in claim 1, further comprising:

a control device configured to control driving of the motor, wherein:

the control device is configured to control rotation speed of the motor when the driving mechanism moves the pin-gripping part forward along the driving axis relative to the fastener-abutment part.

5. The fastening tool as defined in claim 4, wherein the control device is configured to perform constant-rotation-speed control of the motor when the driving mechanism moves the pin-gripping part forward along the driving axis relative to the fastener-abutment part.

6. The fastening tool as defined in claim 5, wherein the control device is configured to perform constant-rotation-speed control of the motor at least for a specified period of time until the pin-gripping part reaches the detection position when the driving mechanism moves the pin-gripping part forward along the driving axis relative to the fastener-abutment part.

7. The fastening tool as defined in claim 1, wherein:

the detection-target part includes a magnet, and the detection device includes a Hall sensor.

8. The fastening tool as defined in claim 5, wherein the controller is configured to perform constant-rotation-speed control of the motor at least for a specified period of time until the pin-gripping part reaches the detection position when the driving mechanism moves the pin-gripping part forward along the driving axis relative to the fastener-abutment part.

9. A fastening tool configured to fasten a workpiece via a fastener, the fastener having a pin and a cylindrical part through which the pin is inserted, the fastening tool comprising:

a housing extending in a front-rear direction of the fastening tool along a driving axis;

a cylindrical fastener-abutment part held by a front end portion of the housing so as to be capable of abutting the cylindrical part;

a pin-gripping part (1) having a plurality of gripping claws configured to grip a portion of the pin, (2) being coaxially held within the fastener-abutment part so as to be movable in the front-rear direction along the driving axis relative to the fastener-abutment part, and (3) being configured such that a gripping force of gripping the pin is changed by movement of the plurality of gripping claws in a radial direction relative to the driving axis along with movement of the pin-gripping part in the front-rear direction relative to the fastener-abutment part;

a detection-target part configured to move with the pin-gripping part in the front-rear direction;

a detection device configured to detect the detection-target part when the pin-gripping part is placed in a detection position in the front-rear direction;

a motor;

a controller; and a driving mechanism configured to (1) be driven by power of the motor, (2) move the pin-gripping part rearward from an initial position along the driving axis relative to the fastener-abutment part so as to pull the pin gripped by the plurality of gripping claws and deform the cylindrical part abutting on the fastener-abutment part, thereby fastening the workpiece via the fastener and breaking the pin at a small-diameter part for breakage, and (3) move the pin-gripping part forward, after the breakage, along the driving axis relative to the fastener-abutment part so as to return the pin-gripping part to the initial position based on a detection result of the detection device, wherein:

the controller is configured to adjust a first moving distance which is a distance by which the pin-gripping part is moved from the detection position to the initial position.

10. The fastening tool as defined in claim 9, wherein the controller is configured to:

cause braking of the pin-gripping part when the pin-gripping part is moved from the detection position by a second moving distance; and adjust the first moving distance by adjusting the second moving distance.

11. The fastening tool as defined in claim 10, wherein:

the detection position is set on a way of the pin-gripping part to be moved forward to the initial position by the driving mechanism, and the controller is configured to, each time when the pin-gripping part is placed in the detection position and the detection-target part is detected by the detection device, cause the pin-gripping part to brake when the pin-gripping part is moved by the second moving distance from the detection position of the detection.

12. The fastening tool as defined in claim 10, wherein the controller is configured to adjust the second moving distance based on a past actual moving distance of the pin-gripping part after braked by the braking device.

13. The fastening tool as defined in claim 9, wherein the controller is configured to:

control operation of the driving mechanism by controlling driving of the motor; and stop the pin-gripping part in the initial position by braking the motor based on the detection result.

14. The fastening tool as defined in claim 13, wherein the controller is configured to adjust the first moving distance by adjusting a braking-standby time, the braking-standby time being a time from when the detection-target part is detected by the detection device until the controller brakes the motor.

15. The fastening tool as defined in claim 9, wherein the controller is configured to adjust the first moving distance according to information inputted via an operation part, the operation part being configured to be externally operable by a user.

16. The fastening tool as defined in claim 9, wherein the controller is configured to:

control driving motor; and control rotation of the motor when the driving mechanism moves the pin-gripping part forward along the driving axis relative to the fastener-abutment part.

17. The fastening tool as defined in claim 9, wherein the controller is configured to perform constant-rotation-speed control of the motor when the driving mechanism moves the pin-gripping part forward along the driving axis relative to the fastener-abutment part.

18. The fastening tool as defined in claim 9, wherein:

the detection-target part includes a magnet, and the detection device includes a Hall sensor.

* * * * *